US008210086B2

(12) United States Patent
Head et al.

(10) Patent No.: US 8,210,086 B2
(45) **Date of Patent: *Jul. 3, 2012**

(54) BRAIDED REINFORCEMENT FOR AIRCRAFT FUSELAGE FRAMES AND METHOD OF PRODUCING THE SAME

(75) Inventors: Andrew Atkins Head, Cincinnati, OH (US); Brad Goetz, Cincinnati, OH (US); John Peter, Morrow, OH (US); Steven Charles Stenard, Cincinnati, OH (US); Thomas C. Story, Cincinnati, OH (US)

(73) Assignee: A&P Technology, Inc., Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/881,895

(22) Filed: Sep. 14, 2010

(65) Prior Publication Data

US 2011/0283870 A1 Nov. 24, 2011

Related U.S. Application Data

(63) Continuation of application No. 12/017,964, filed on Jan. 22, 2008, now Pat. No. 7,793,576.

(60) Provisional application No. 60/886,010, filed on Jan. 22, 2007.

(51) Int. Cl.
*D04C 3/40* (2006.01)

(52) U.S. Cl. ..... 87/34

(58) Field of Classification Search ..... 87/6, 9, 87/34

See application file for complete search history.

(56) References Cited

U.S. PATENT DOCUMENTS

| | | | |
|---|---|---|---|
| 838,899 | A | 12/1906 | Quambusch |
| 1,188,741 | A | 6/1916 | Dunkerley |
| 2,111,639 | A | 3/1938 | Petersen |
| 2,232,524 | A | 2/1941 | Hackbarth |
| 5,127,307 | A | 7/1992 | Pimpis |
| 5,398,586 | A | 3/1995 | Akiyama et al. |
| 5,690,297 | A | 11/1997 | McNeil et al. |
| 6,365,257 | B1 | 4/2002 | Hecht |
| 6,510,961 | B1 | 1/2003 | Head et al. |
| 7,093,527 | B2 | 8/2006 | Rapaport et al. |
| 7,793,576 | B2 * | 9/2010 | Head et al. ..... 87/34 |

* cited by examiner

*Primary Examiner* — Shaun R Hurley
(74) *Attorney, Agent, or Firm* — Hahn Loeser & Parks LLP

(57) ABSTRACT

A method for applying a braided fabric over a mandrel using a braiding apparatus having a central axis and providing braiding yarns drawn toward a braiding point where a braid is formed on the mandrel, the method comprising the steps of advancing the mandrel through the braiding point of the braiding apparatus, determining a current position of the mandrel; and controlling the position of the mandrel transversely to the central axis of the braiding apparatus responsive to the current position such that a center point of a mandrel cross-section passing through the braiding apparatus is coincident with the braiding point.

25 Claims, 23 Drawing Sheets

BRAIDED REINFORCEMENT FOR AIRCRAFT FUSELAGE FRAMES AND METHOD OF PRODUCING THE SAME

The present application is a continuation of U.S. Pat. No. 7,793,576, previously U.S. patent application Ser. No. 12/017,964, filed on Jan. 22, 2008, which claims priority to U.S. Provisional Patent Application No. 60/886,010, filed on Jan. 22, 2007, the disclosures of both of which are hereby incorporated herein by reference.

BACKGROUND AND SUMMARY

This invention relates to braid production, and more particularly to a braid product formed on a mandrel, the mandrel approximating the shape of a wheel with a varying radius of curvature.

It is known in the art that a variety of braided products may be formed over mandrels having the desired shape of the braided product. One common type of mandrel onto which a braid can be formed is straight in shape, with a fixed central longitudinal axis oriented to be coaxial with the braid axis. As a result, the braid is applied symmetrically around the mandrel. Another type of mandrel is circular in shape (like a wheel), with the braiding surface of the wheel being tangentially aligned with the longitudinal axis of the braiding apparatus. The wheel is further oriented so that the cross-section of the mandrel is centered in the braiding apparatus. As a result, the center point of the cross-section of the mandrel along its circumferential length remains coaxial with the braiding point as the wheel is rotated around its center, supporting a symmetric application of the braid.

However, where the shape of a mandrel approximates a circle or wheel with an irregularly varying radius of curvature, symmetrical application of braid around the mandrel and along its circumferential length cannot be accomplished by simply rotating the mandrel about an approximate center. Therefore, there is a need for a braiding machine and process to apply braid symmetrically to mandrel with a shape which approximates a circle or wheel but has an irregularly varying radius of curvature.

Disclosed are machine and method for applying braid by means of a braiding machine to a mandrel, where the mandrel has an irregularly varying radius of curvature along its length. The braiding machine includes a braiding apparatus for depositing a tubular braid over the mandrel by drawing yarns toward a braiding point where the tubular braid is initially formed on the mandrel. The braiding point lies along a central axis of the braiding apparatus that may be oriented, for example, in a y-direction.

The braiding machine further includes at least one mandrel placement assembly for positioning the mandrel in an x-direction within a plane that is orthogonal to the central axis at the braiding point, and for advancing the mandrel along its length. As the mandrel is advanced, the mandrel placement assembly repositions the mandrel relative to the x-direction so that a center point of a cross-section of the mandrel that lies in a plan that is orthogonal to the central axis is made to be coincident with the braiding point.

Each mandrel placement assembly includes opposing drive/positioning wheels for frictionally contacting opposing outer surfaces of the mandrel in reference to a center point of the radius of curvature, respectively. The opposing drive/positioning wheels are operative to rotate in frictional contact at least one of the outer surfaces of the mandrel, thereby advancing the mandrel along its length.

The opposing drive/positioning wheels are carried by a carriage that is pivotable about an axis that is transversely positioned with respect to the central axis of the braiding apparatus, and is fixed in relation to the braiding point. The drive/positioning wheel assemblies further include opposing side wheels orthogonally positioned in relation to the opposing drive/positioning wheels, for maintaining the position of the mandrel with respect to a z-direction of the braiding machine.

The opposing drive/positioning wheels are rotated by means of a drive mechanism coupled to one or more motors, and the drive/positioning wheels, carriage and side wheels are manipulated by means of linkage mechanisms couple to linear actuators. The motors and linear actuators may be controlled, for example, by a computer numerical control (CNC) controller which is operable to determine a current position of the mandrel at the braiding point in the x-direction as a function of the radiuses of curvature along the length of the mandrel.

BRIEF DESCRIPTION OF THE DRAWINGS

These and other objects and advantages of the present invention will become more readily apparent from the following detailed description, taken in conjunction with the drawings, in which.

DETAILED DESCRIPTION OF THE DRAWINGS

Figure 1:
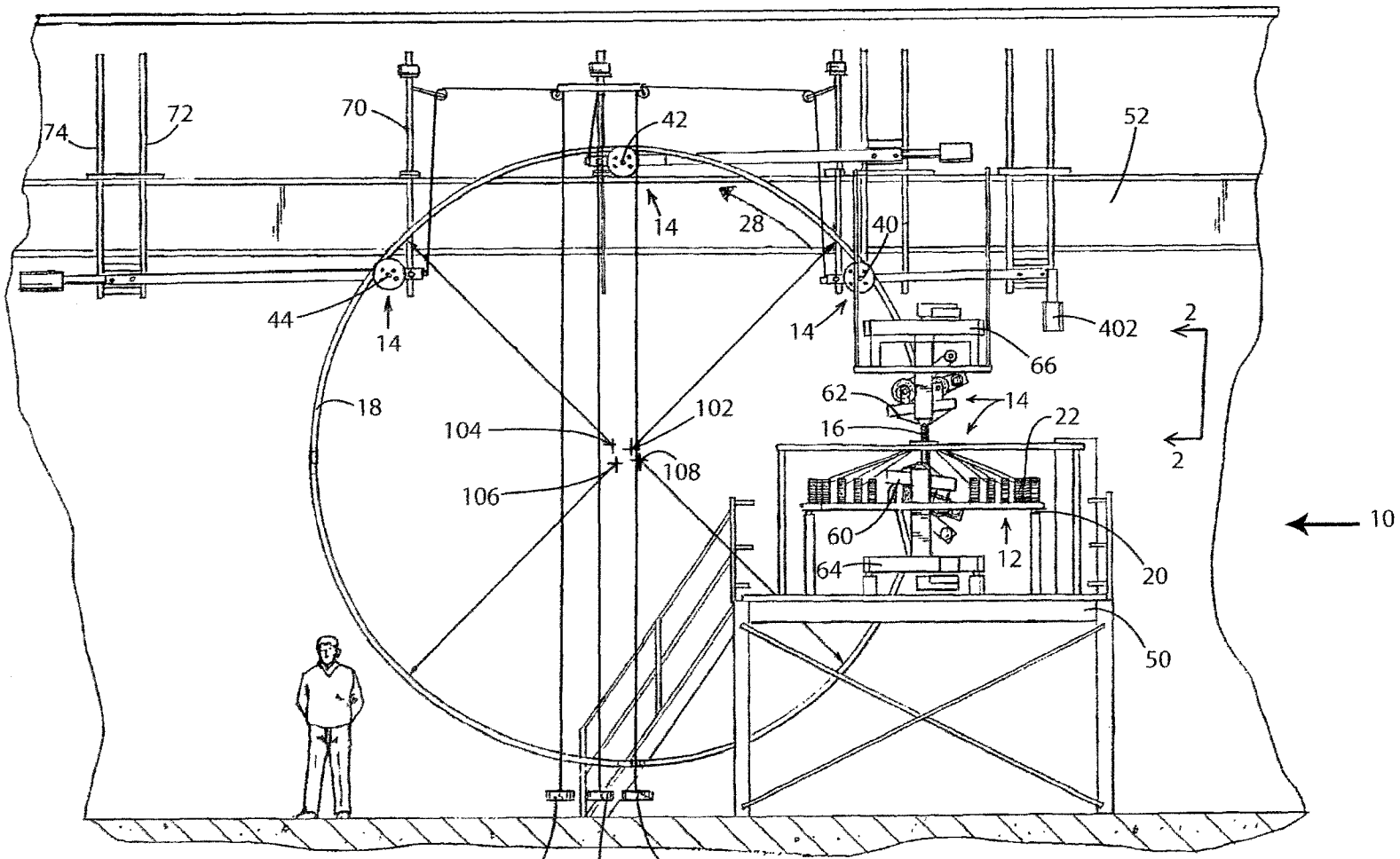
FIG. 1 is a side-view of a braiding machine.
Figure 3A:
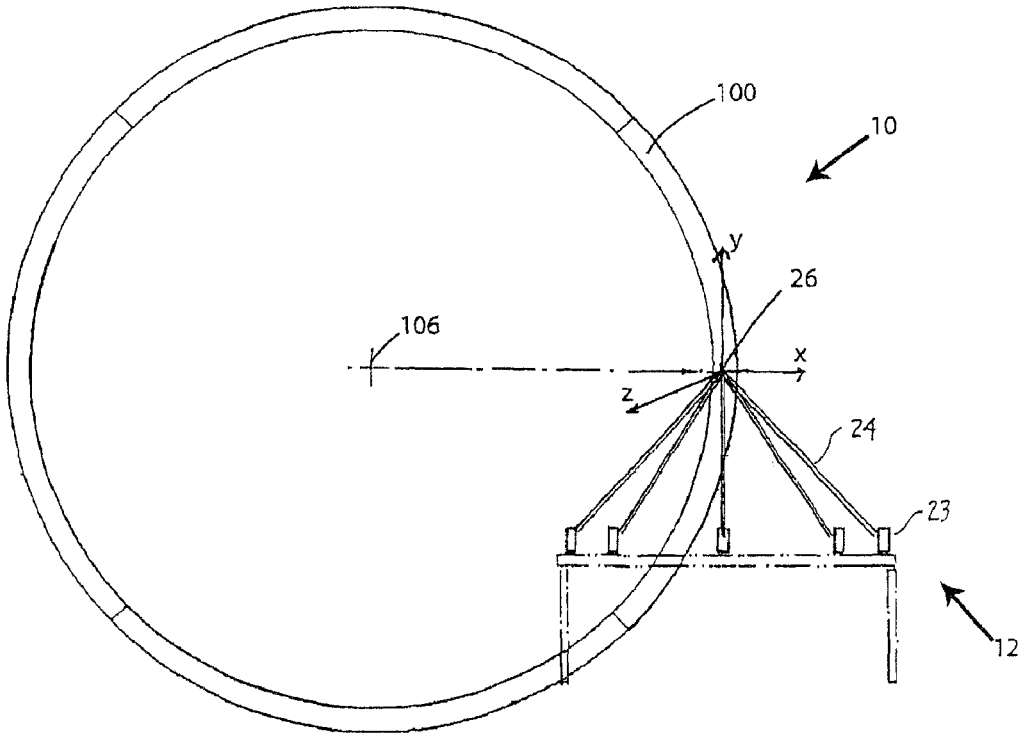
FIG. 3A is a mandrel which is circular in shape, e,g., analogous to a wheel.

FIG. 1 is a side view of a braiding machine 10, including a braiding apparatus 12 and a mandrel positioning assembly 14 according to an embodiment of this invention. The braiding apparatus 12 deposits a tubular braid 16 over a mandrel 18. The braiding apparatus 12 includes a track plate 20, yarn carriers 22, a former (not shown) and a take-up device (i.e., the mandrel 18). A track plate 20 provides support for carriers 22 (which house the yarn packages 23) to travel along paths defined by tracks (not shown) in order to dispense a predetermined braid configuration, for example, a biaxial or triaxial braid, as is known in the art. This assembly causes the yarns 24 to take on the desired architecture of the braid 16. The point that the unbraided yarns 24 become the completed braid 16 is called the braiding point 26 (as shown in FIG. 3A). The braiding point 26 is located at a central axis of the axis of the track plate 20 and above the carriers 22.

Figure 7:
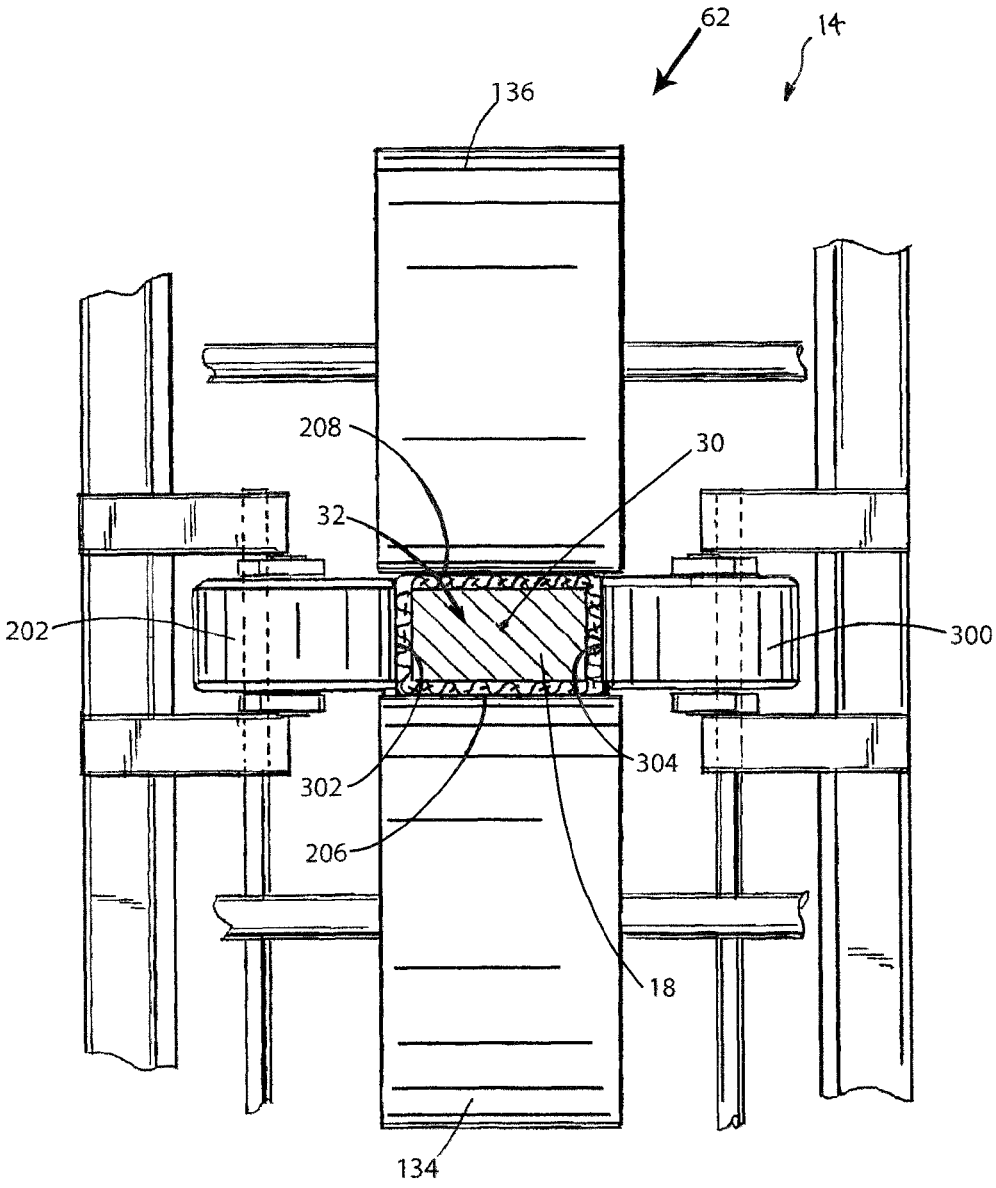
FIG. 7 is a sectional view of a mandrel cross-section passing through the braiding point so that the cross-section is coaxial with the braiding point.

The braid 16 is produced normal to the plane of the track plate 20. The mandrel 18 may, for example, be generally circular and oriented with its face being tangential to the longitudinal axis of the braiding apparatus 12. The tubular braid 16 is formed around the circumferential length of the mandrel 18 as the mandrel 18 advances in the direction indicated by the arrows 28. To ensure that the braid 16 is symmetrically applied to the mandrel 18, the center point 30 of the cross-section 32 of the mandrel 18 (as shown in FIG. 7) being advanced across the braiding point 26 is coaxial with the braiding point 26.

Multiple layers of braid 16 can be applied to the mandrel 18 to produce a finished braided product. It will be appreciated by persons skilled in the art that braiding apparatus 12 and the process of providing braid 16 to mandrel 18 are well known in the art and therefore will not be described further herein. In addition, those skilled in the art will appreciate that the invention is not limited to the use of braiding apparatus 12 as described herein, and that any suitable braiding apparatus, as is presently known in the art or upon improvement, may be used for forming braid 16 around the circumferential length of mandrel 18.

The braiding machine 10 includes the mandrel placement assembly 14 (as shown in FIG. 1), The mandrel placement assembly 14 positions the mandrel 18 in space so that the center point 30 of the mandrel cross-section 32 (as illustrated, for example, in FIG. 7) along the circumferential length of the mandrel 18 is coaxial with the braiding point 26. In this way, braid 16 may be symmetrically applied to the mandrel 18. The mandrel placement assembly 14 also urges the mandrel 18 to advance in the direction of arrow 28 for application of the braid 16 along the circumferential length of the mandrel 18 and carries the load of the mandrel 18. Other components may additionally be provided in mandrel placement assembly 14 to carry and move the mandrel 18 (for example, support wheels 40, 42, 44 as described in more detail below with reference to FIGS. 9 and 10A through 10C).

FIG. 1 also illustrates several other optional structural components of the braiding machine 10. The braiding apparatus 12 can be positioned on a mezzanine 50 in order to accommodate variations in the size of the mandrel 18. The braiding machine 10 can also include an overhead crane beam 52 to provide a load bearing capacity for the components of the machine 10.

The mandrel placement assembly 14 as shown in FIG. 1 includes drive/positioning; wheel assemblies 60, 62 and support wheels 40, 42, 44. Each of the drive/positioning wheel assemblies 60, 62 is supported by a frame 64, 66, respectively, The frame 64 may be attached to the mezzanine 50 as a base. The frame 66 may be attached to the crane beam 52. Vertical arms 70, 72, 74 may be attached to various components that enable the operation of support wheel 44 (similar structures may be use in support of support wheels 40 and 42). Vertical arms 70, 72, 74 may be attached to the crane beam 52. Many design alternatives may be considered for these support structures. As a result, the support structures do not limit the scope of this invention.

Figure 2:
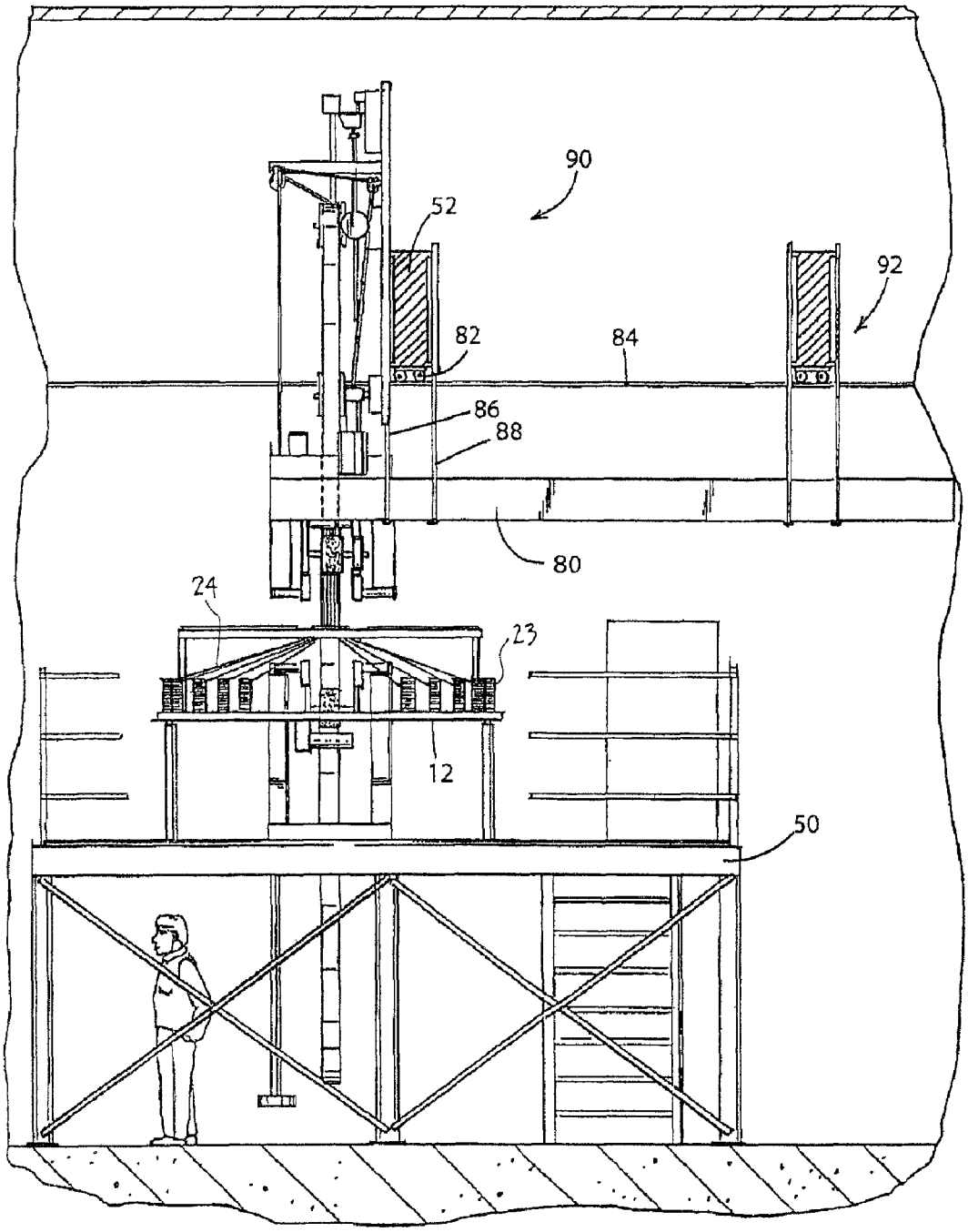
FIG. 2 is a side-view of the braiding machine along the lines 2-2 in FIG. 1, with a portion of a mezzanine railing cutaway to allow for a clear illustration of the braiding apparatus.

FIG. 2 is a side view of the braiding machine along the lines 2-2 in FIG. 1, with a portion of the mezzanine 50 railing cut away to allow for a clear illustration of the braiding apparatus 12. The crane beam 52 cross-section is shown revealing a moveable attachment to a cross bar 50. More particularly, the crane beam 52 is shown to include a wheel structure 82 that enables movement along a rail 84. Vertical arms 86, 88 connect the crane beam 52 to the cross bar 80, such that crane beam 52 forms part of a gantry 90 designed to travel along a rail 84 and across beam 80. The gantry 90 as depicted allows the mandrel 18 and mandrel placement assembly 14 (shown in FIG. 1) structure to be repositioned, for example, along the length of the cross bar 80 for use in another braiding machine 10 (not shown). For example, as shown in FIG. 2, a new location 92 for the crane beam may be used to support another mandrel placement assembly (not shown).

One common type of mandrel (not shown) onto which a braid can be formed is straight in shape, with a fixed central longitudinal axis oriented to be coaxial with the braid axis. As a result, the braid is applied symmetrically around the mandrel. As shown in FIG. 3A, another type of mandrel 100 is circular in shape (like a wheel 100), with the face of the mandrel 100 being tangentially oriented to the longitudinal axis of the braiding apparatus 12. A cross-section of the mandrel 100 is centered in the braiding apparatus 12. As a result, the center point of the cross-section of the mandrel 100 along its circumferential length is coaxial with the braiding point 26. In this case, because the mandrel 100 is uniformly circular, merely rotating the circular mandrel 100 around its center aligns the center point of the cross-section along the circumferential length to be coaxial with the braiding point for symmetric application of the braid.

In contrast to the circular mandrel 100 of FIG. 3A, the mandrel 18 of FIG. 1 approximates a circle, but has an irregularly varying radius of curvature. Points 102, 104, 106, 108 represent the centers of various arcuate segments of the approximate circle, Therefore, application of braid 16 to form around the mandrel 18 along its circumferential length cannot be accomplished by the rotation of the mandrel 18 about one approximate center.

Figure 3B:
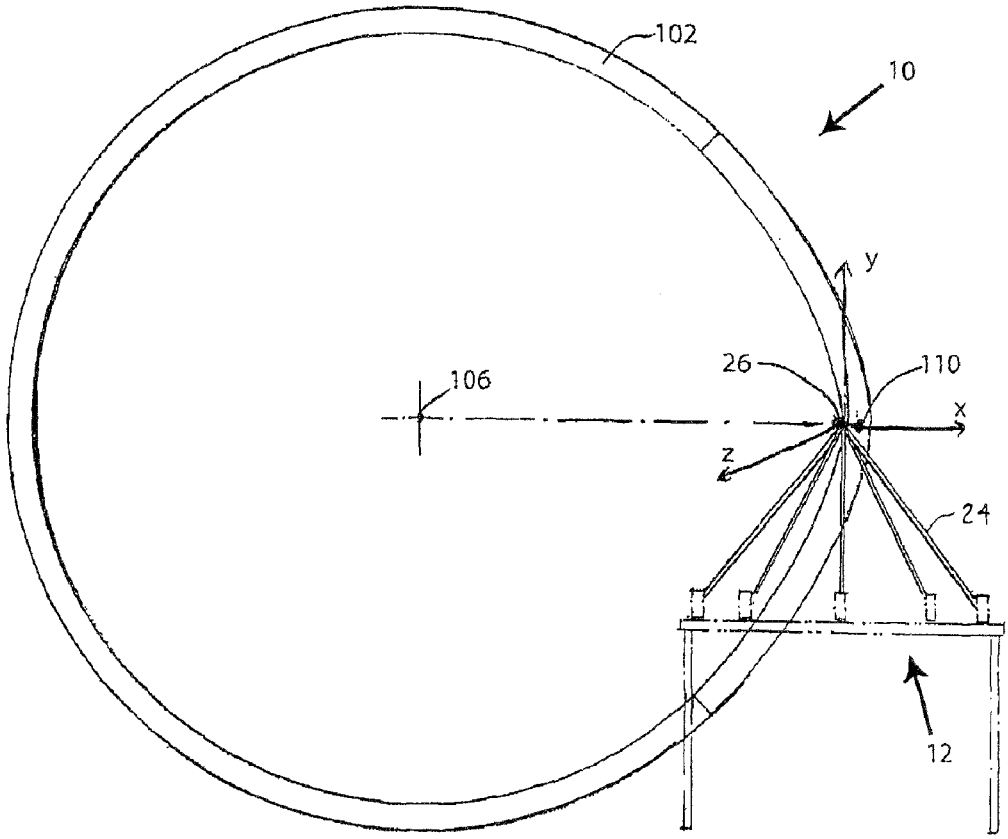
FIG. 3B illustrates another mandrel with an irregularly varying radius of curvature compared to the mandrel in FIG. 3A.
Figure 3C:
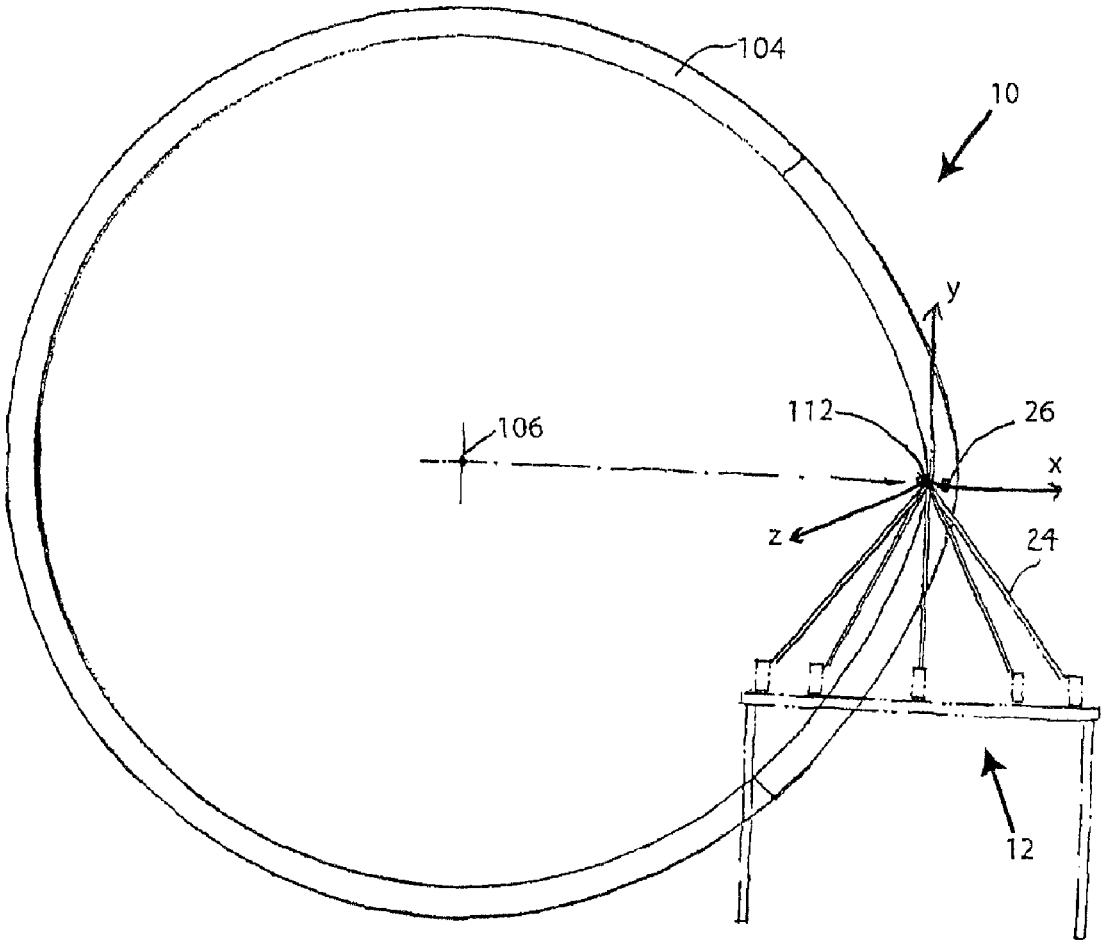
FIG. 3C illustrates another mandrel with a different irregularly varying radius of curvature than the mandrels in FIGS. 3A and 3B.

FIGS. 3A-3C are diagrammatic side views of mandrels 100, 102, 104 with different variations in their radius of curvature and the effect of such variations on the positioning of the center point of the mandrel 100, 102, 104 cross-section as it passes through the braiding point 26. The braiding point 26 is identified by x-y-z axes at x=O, y=0 and z=0. FIG. 3A illustrates the mandrel 100 passing through the braiding point 26 with a constant radius of curvature which, if continuous for 360 degrees, would define a mandrel 18 with a circular shape, for example, as shown in this figure. For the FIG. 3A mandrel 100, the point of rotation of the mandrel 100 is the center 106 of the circle. Since the braiding point 26 and center point (also at reference number 26) of the mandrel 100 cross-section are coaxial, the mandrel 100 center point also is positioned at x=0, y=0 and z=0 as it passes through the braiding apparatus.

FIG. 3B illustrates a mandrel 102 with an irregularly varying radius of curvature compared to that in FIG. 3A. As it passes through the braiding point 26 based on rotation around the approximate center of the approximately circular mandrel 102 (for example, the center 106 associated with the FIG. 3A mandrel 100) the center point 110 of the mandrel 102 cross-section moves to a position shown as x=2, y=0, and z=0 as it passes through the braiding apparatus, which is displaced from the braiding point 26. Were braid 16 to be applied to this misaligned center point 106 of the mandrel 102 cross-section, the braid would form asymmetrically on the mandrel 102.

Similarly, FIG. 3C illustrates a mandrel 104 with a different irregularly varying radius of curvature than the mandrels 100, 102 of FIGS. 3A and 3B. As a result, the center point 112 of the mandrel 104 cross-section moves to a position shown as x=−2, y=0, and z=0 as it passes through the braiding apparatus, which is also displaced From the braiding point 26. Therefore, in order for braid 16 to be symmetrically applied to the FIGS. 3B and 3C mandrels 102, 104, respectively, the mandrels 102, 104 have to be repositioned as they are rotated so that each of the center points 110, 112 of the cross-sections of mandrels 102, 104, respectively, remain at the x=0, y=0, and z=0 position.

Figure 4:
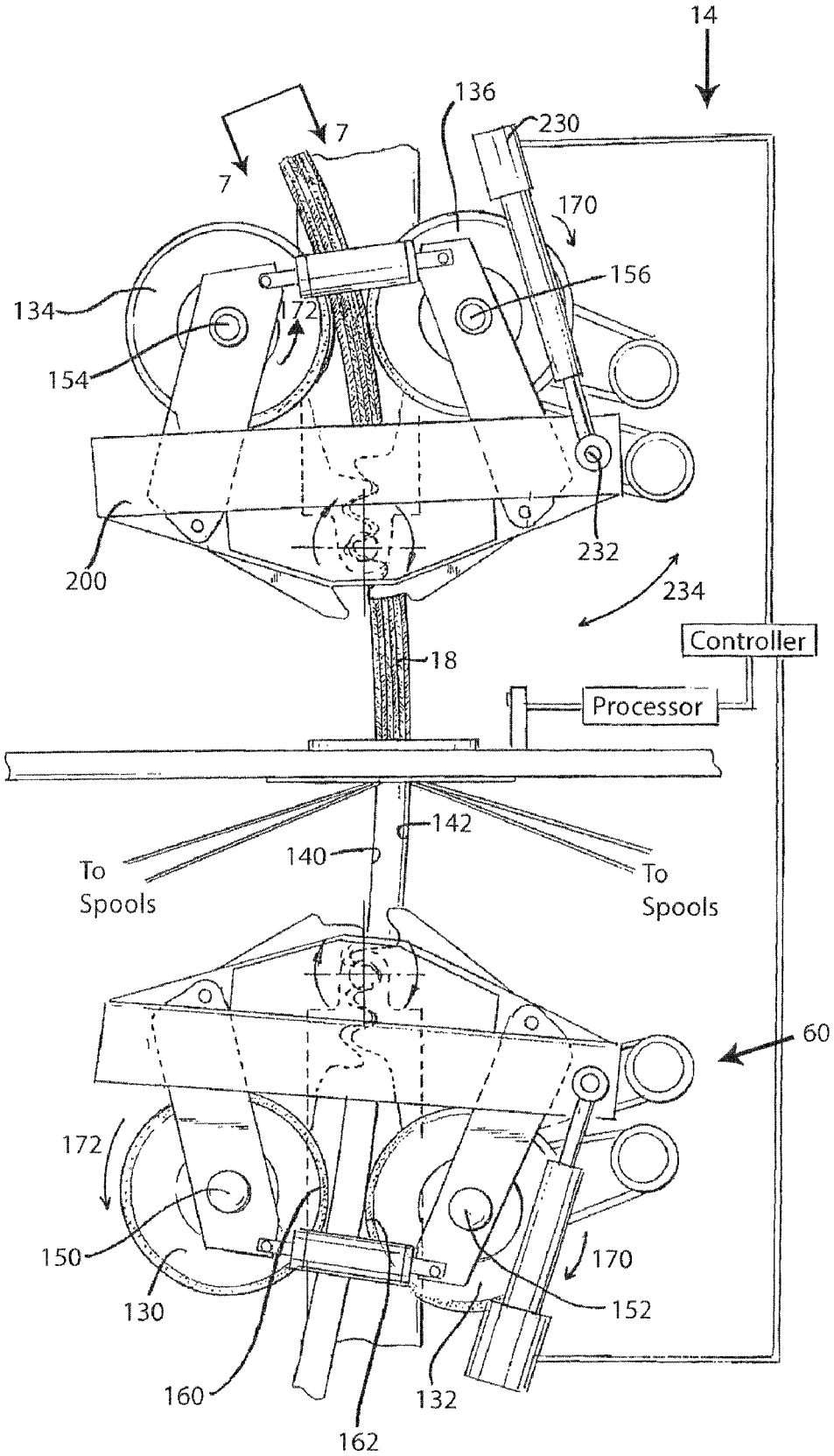
FIG. 4 is a fragmentary side view of the upper and lower drive/positioning wheel assemblies.

The mandrel placement assembly 14 of the present invention includes upper and lower drive/positioning wheel assemblies 60, 62 which are directed to achieve this repositioning. FIG. 4 is a fragmentary side view of the upper and lower drive/positioning wheel assemblies 60, 62. The assemblies 60, 62 may be essentially identical to each other, and positioned as mirror images of each other symmetrically above and below the braiding point 26 (shown in FIG. 4). Each of the upper and lower drive/positioning wheel assemblies 60, 62 can include two drive/positioning wheels 130, 132 and 134, 136, respectively. The surfaces of the drive/positioning wheels 130, 132 and 134, 136 contact the mandrel 18. More particularly, drive/positioning wheel 134 of the upper drive/positioning wheel assembly 62 and drive/positioning wheel 130 of the lower drive/positioning wheel assembly 60 contact the surface 140 defining an inner diameter of the mandrel 18, and drive/positioning wheel 136 of the upper drive/positioning wheel assembly 62 and drive/positioning wheel 132 of the lower drive/positioning wheel assembly 60 contact the surface 142 defining an outer diameter of the mandrel 18.

The drive/positioning wheels 130, 132 and 134, 136 provide the primary functionality of the mandrel placement assembly 14 by providing two types of movement. First, each set of drive/positioning wheels 134, 136 and 130, 132, (hereafter, the lower drive/positioning wheels 130, 132 will be described for illustration), can be moved in tandem in space so that the centers 150, 152 of each of the two wheels 130, 132 of the set, respectively, are relocated in order for the drive/positioning wheel surfaces 160, 162, respectively, to apply forces to the inner and outer diameter surfaces 140, 142 of the mandrel 18, the forces being normal to the tangent at the point of contact on the mandrel 18. The forces applied to the inner and outer diameter surfaces 140, 142 act to reposition the mandrel 18 so that the center point 30 of the mandrel cross-section 32 (for example, as shown in FIG. 7) is coaxial with the braiding point 26. In this way, the braiding apparatus 12 can apply braid 16 symmetrically to mandrel 18 even if the mandrel 18 has an irregularly varying radius of curvature.

Secondly, drive/positioning wheels 130, 132 or 134, 136 rotate in the directions 170, 172 shown in FIG. 4 to cause the mandrel 18 to rotate upwardly in a counterclockwise direction, as indicated by arrow 28 in FIG. 1, for application of the braid 16 along the circumferential length of the mandrel 18. The drive/positioning wheels 130, 132 and 134, 136 also hold the rotating mandrel 18 in space by supporting a portion of the load of the mandrel 18 (along with, for example as shown in FIG. 1, support wheels 40, 42, 44, which are described further below with reference to FIGS. 9 and 10A-10C).

Figure 5A:
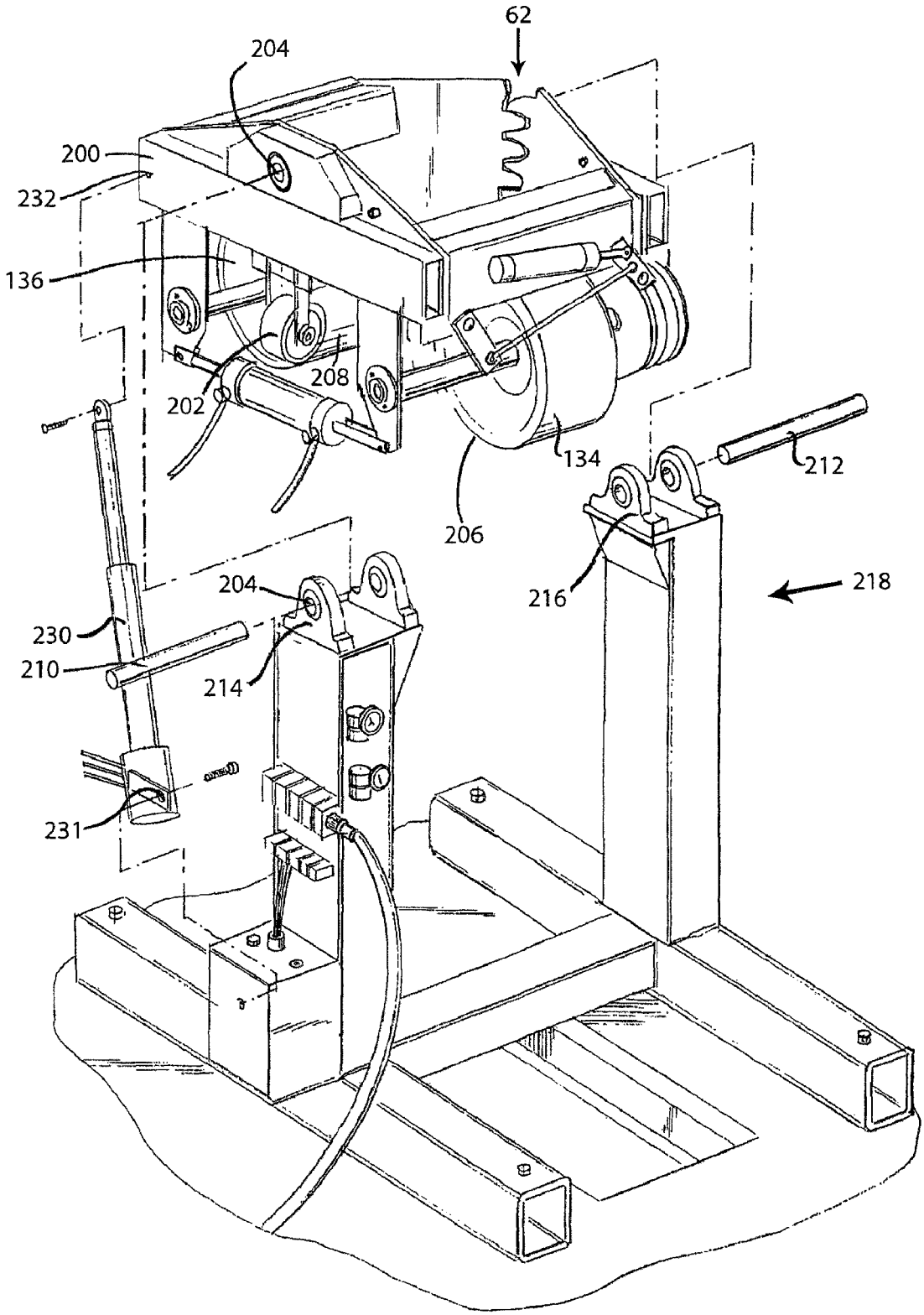
FIG. 5A is an exploded view of one of the drive/positioning wheel assemblies with respect to a carriage to which the assembly is attached.
Figure 5B:
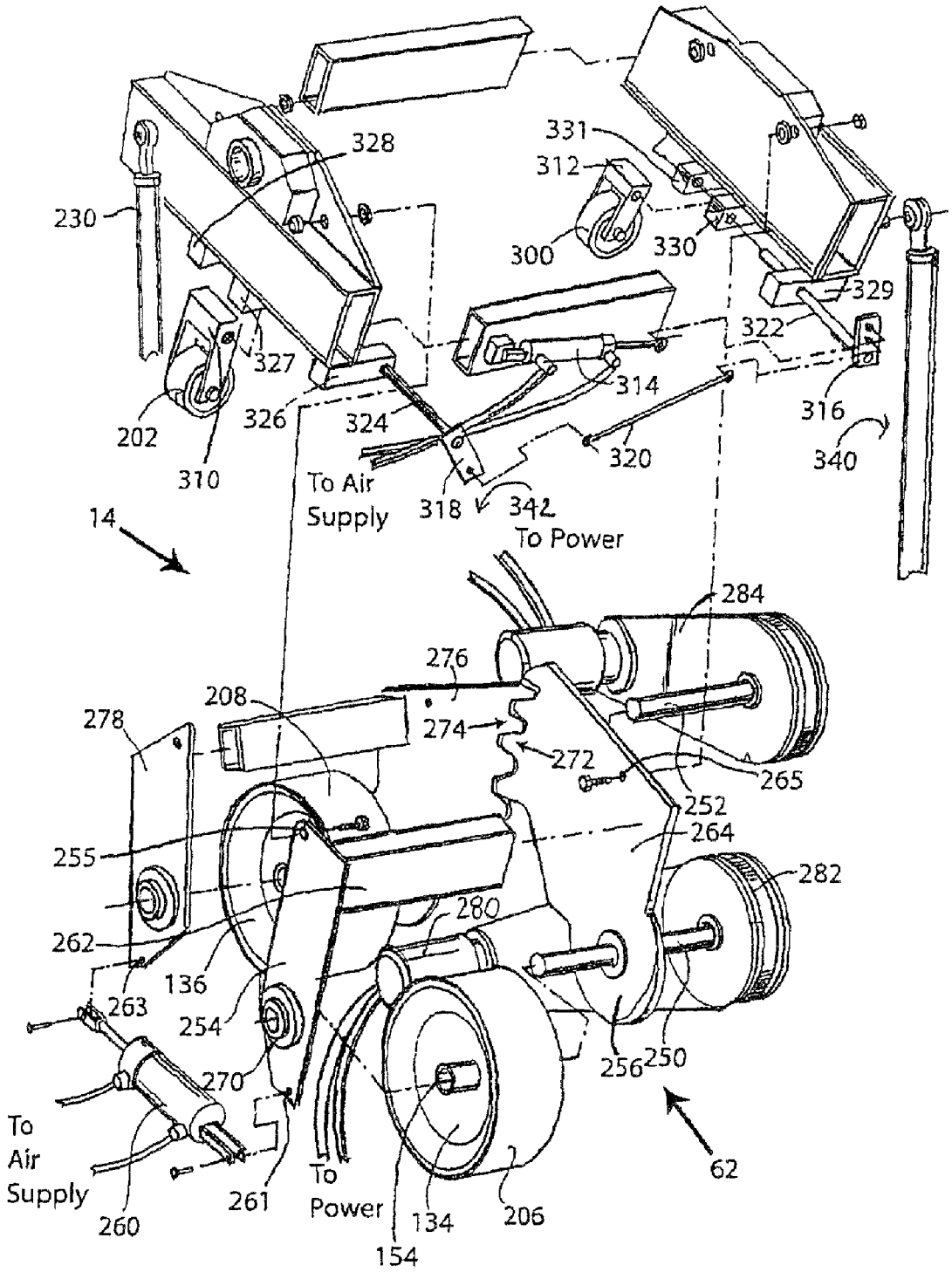
FIG. 5B is an exploded view of the FIG. 5A assembly.

FIGS. 5A and 5B are perspective exploded views of a drive/positioning wheel assembly 60 or 62. The upper drive/positioning wheel assembly 62 is described for illustration; as essentially identical components comprise the lower drive/positioning wheel assembly 60. The drive/positioning wheel assembly 62 as illustrated in FIGS. 5A and 5B includes a carriage 200 to which two drive/positioning wheels 134, 136 and two side wheels 202 (only side wheel 202 is shown) are fixedly attached. The carriage 200 pivots around a central pivot point 204, whereby the drive/positioning wheels 134, 136 may be repositioned such that the surfaces 206, 208 of the wheels 134, 136 impose a force against the mandrel 18 (shown in FIG. 4) in order to position the mandrel 18 in space. The carriage 200 also includes two pivot rods 210, 212 on opposite sides which define the pivot point 204. The pivot rods 210, 212 may be moveably housed within pillow bearings 214, 216 which are carried by a carriage support beam 218. The carriage support beam 218 supports the load of the carriage 200. With reference also to FIG. 4, a VERSARAM 230 (or other suitable mechanical linear actuator) is fixedly connected to the carriage support beam 218 via plate 231 and to one side of the carriage 200 at a point of attachment 232.

Figure 6:
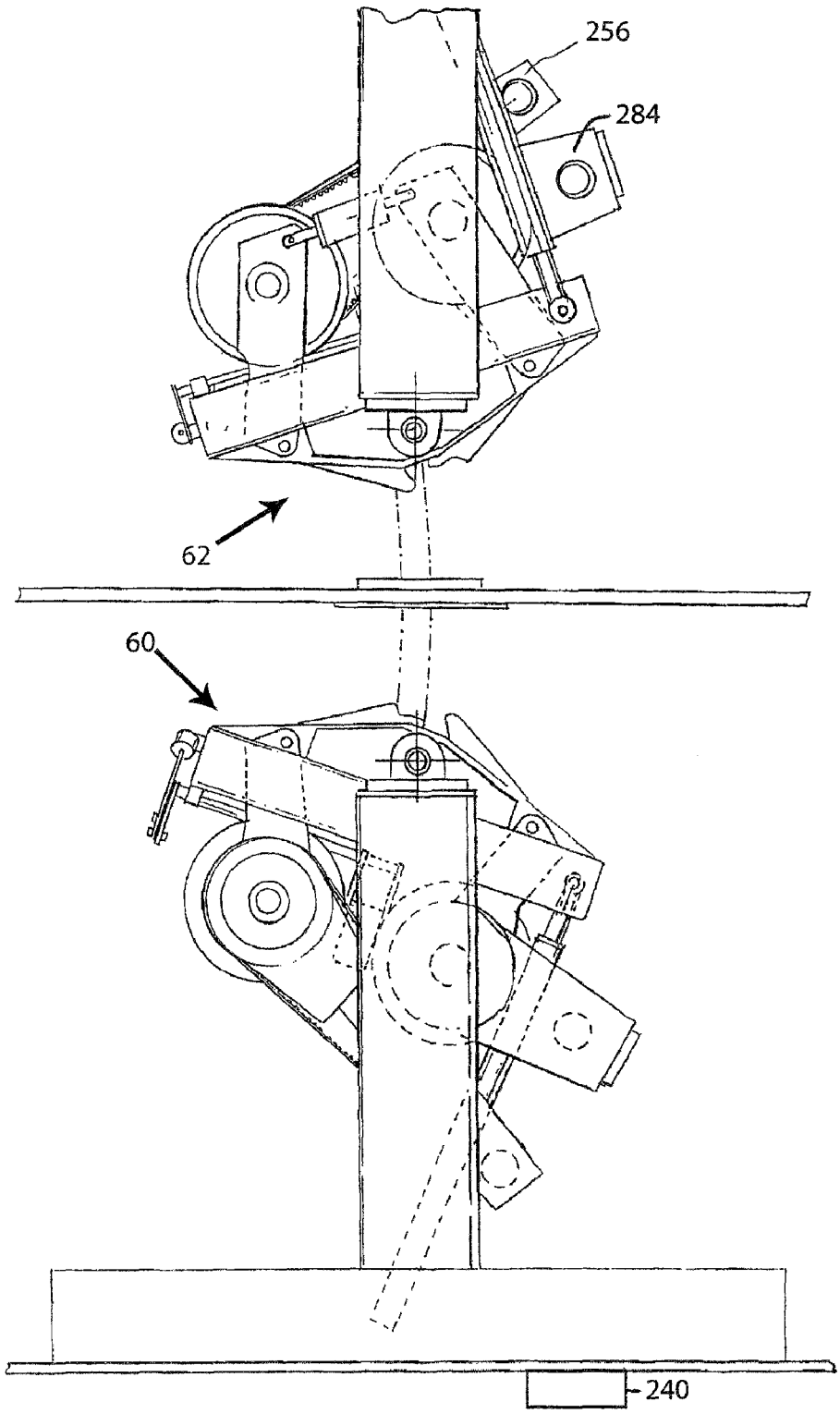
FIG. 6 is a side view of the upper and the lower drive/positioning wheel assemblies.

With reference also to FIG. 4, the VERSARAM 230 extends and retracts to drive the carriage 200 so that the point of attachment of the VERSARAM 232 to the carriage 200 moves in the direction of the arrows 234, thereby actuating the rotation of the carriage 200 about the pivot point 204. The carriage 200 houses the drive/positioning wheel assemblies 60 and 62 so that movement of the carriage 200 causes displacement of the drive wheels 134, 136. Therefore, the VERSARAM 230 actuates displacement of the drive wheels 134, 136 to provide movement of the location of application of forces to the mandrel 18. The VERSARAM 230 may be built, for example, on a ball screw (not shown) which is powered by a servo motor 240 (shown in FIG. 6) and controlled by a binomial driver air cylinder (not shown). The motor 240 associated with the VERSARAM 230 can be located outside the carriage support frame 218 in order to accommodate the curved mandrel 18. The motor 240 drives the arm of the VERSARAM 230 inwardly and outwardly, whereby the drive/positioning wheel assemblies 60, 62 are actuated for rotation around the pivot point 204.

The drive/positioning wheels assemblies 60, 62, for example, upper drive/positioning wheel assembly 62, is now further described with reference to FIGS. 5A and 5B. Each of the drive/positioning wheels 134, 136 having central axis 154, 156, is mounted on a rotatable shaft 250, 252, respectively. Drive/positioning wheel 134 will be described for illustration; as drive/positioning wheel 136 is essentially identical to wheel 134. One end of the shaft 250 fixedly connects the wheel 134 to a drive wheel holder plate 254 and the other end of the shaft 250 rotatably connects the wheel 134 to a drive wheel support portion 256 of a teeth plate 264 (similarly, the teeth plate 276 includes a support portion 284). The wheel 134 therefore is cradled between a holder plate 254 and the drive wheel support portion 256, which are on opposite sides of the wheel 134. Also, the holder plate 254 and the drive wheel support portion 256 are located on opposite sides of the carriage 200. The wheel 134 is mounted proximally to one end of the holder plate 254, and that end of the plate 254 is fixedly connected to one end of an air cylinder 260 at connection point 261. The other end of the holder plate 254 is fixedly connected to a cross beam 262, which in turn is fixedly connected to the teeth plate 264.

Movement of the holder plate 254 directs movement of the teeth plate 264. One end of the teeth plate 264 contains geared teeth 272 (which interact with geared teeth on the adjacent teeth plate 276 for support of the movement of drive wheel 134). However, the geared teeth 272 are oriented on the side opposite the holder plate 254 within the carriage 200. Therefore, a cross beam 262 is perpendicular to the plane of the teeth plate 264 and extends across the carriage 200 in between holder plate 254 and teeth plate 264. The connection between the holder plate 254 and the carriage 200 at connection point 255 is on the end of the holder plate 254 opposite the end connected to the air cylinder 260, with attachment point 261. Each of the holder plates 254, 278 are rotatably connected to the carriage 200 at the end opposite the air cylinder 260. For example, holder plate 254 is notably attached to the carriage 200 at a connection point 255. Similarly, the teeth plates 264 and 276 are notably connected to the carriage 200. For example, teeth plate 264 connects to the carriage 200 at connection point 265.

The shaft 250 inserted through the wheel 134 is rotatably mounted through the holder plate 254 via a fixed connection 270 on the holder plate 254. In this way, while rotation of the shaft 250 causes rotation of the wheel 134, movement of the holder plate 254 also causes movement of the wheel 134 such that the central axis 154 of the wheel 134 can be repositioned at the same time that the wheel 134 is rotated. The teeth 272 of the teeth plate 264 are engaged with the teeth 274 of an opposing teeth plate 276 to which the holder plate 278 for the other wheel 136 is connected. For example, for the upper drive/positioning wheel assembly 62, wheel 134 is attached to the teeth plate 264 through the drive wheel support portion of the plate 256.

The air cylinder 260 is rotatably connected to the ends of the holder plates 254, 278 at connection points 261, 263 opposite the connection points to the teeth plates 264, 276, respectively. Therefore, actuation of the air cylinder 260, which is binary, impinges or retracts the ends of the holder plates 254, 278 and, hence, moves the wheels 134, 136 away or towards, respectively, the mandrel 18. Despite the air cylinder's 260 binary operation, as multiple layers of braid 16 are formed on the mandrel 18, the drive/positioning wheels 130, 132 and 134, 136 must be repositioned to contact the altered mandrel surface due to the thickness of the braided layers (not shown), In this case, air can be backed out of the air cylinder 260 to accommodate such adjustments. Should the layers of braid thickness be more substantially increased (for example, to 10, 20, or 30 or more layers), additional adjustment means as are known in the art may be required.

Repositioning of the drive/positioning wheels 134, 136 is accomplished as follows: when the air cylinder 260 is open, the wheels 134, 136 are retracted away from the inner and outer diameter surfaces 140, 142, respectively, of the mandrel 18. The open position of the set of wheels 134, 136 enables the mandrel 18 to be fed into the braiding machine 10 (described further in the text accompanying FIGS. 17A and 17B), and for adjustments to the positions of the wheels 134, 136 position during interruptions in the braiding process, When the air cylinder 260 is closed, the wheels 134, 136 impinge against the mandrel 18, and the teeth 272, 274 of the teeth plates 264, 276, respectively, are urged in an upward direction. Movement of each of the wheels 134, 136 is coordinated with the other wheel 136, 134, respectively, through the contact point of the teeth 272, 274. In this way, the application of force by the wheels 134, 136 to the mandrel 18 is stabilized by forcing the wheels 134, 136 to move together, and by ensuring that the positioning of the wheels 134, 136 is always equidistant from a common axis through the center point 30 of the mandrel 18 to maintain a symmetric application of force against the mandrel 18. While one design of components for positioning the wheels 134, 136 in this manner is disclosed herein, other designs within the skill of the art are also contemplated, and the example disclosed is not, as a result, intended to limit the scope of the invention.

Support portion 256 includes a housing for the motor 280 and components to provide rotation of the drive/positioning wheel 134. The support portion 256 connects to the rotatable shaft 250 at one end and to the motor 280 at the opposite end. The motor 280 drives a power gear (not shown), which in turn drives a cog belt 282. The cog belt 282 is wrapped around the drive/positioning wheel idler (not shown) in order to rotate the drive/positioning wheel 134 upon rotation of the cog belt 282.

The mandrel placement assembly 14 controls the positioning of the mandrel 18 by altering the position of the upper and lower drive/positioning wheels 62, 60 relative to each other. During operation of the braiding apparatus 12 and mandrel placement assembly 14 illustrated in FIG. 1, the movement of the upper and lower drive/positioning wheel assemblies 62, 60 relative to each other, positions the mandrel 18 so that the center point 30 of the mandrel 18 cross-section 32 is coaxial with the braiding point 26. The movement of drive/positioning wheel assemblies 62, 60 relative to each other can be symmetric or asymmetric in order to coordinate the positioning of the mandrel 18 segment between them as required.

The position of the drive/positioning wheel assemblies 62, 60 changes based on irregular variations in the radius of curvature of the mandrel 18. For example, where there is a segment of the mandrel 18 with a constant radius of curvature, each of the drive/positioning wheel assemblies 62, 60 will be equa-angular with +45 degrees and −45 degrees such that they are at equal angles but in opposite directions. However, the larger the variation in the radius of curvature, the greater the movement of the drive/positioning wheel assemblies 62, 60. As suggested for example in FIG. 6, the rotational positions of the drive/positioning wheel assemblies 62, 60 may be varied between, for the upper drive/positioning wheel assembly 62, level and right hand high and, for the lower drive/ positioning wheel assembly 60, level and right hand low. At the extreme positions, the VERSARAM 230 (for assembly 62) is fully retracted and the drive/positioning wheel assembly 62 is oriented at maximum rotation.

Each drive/positioning wheel assembly 62 or 60 may in addition include two side wheels (for example, side wheels 202, 300 for the upper drive/positioning wheel assembly 62) to assist in keeping the mandrel 18 centered in between the drive/positioning wheels 134, 136. FIG. 7 is a plan view of the mandrel placement assembly 14 drive/positioning wheel assembly 62 and side wheels 202, 300 impinging against the surfaces of the cross-section 32 of the mandrel 18 along the lines 7-7 and in the direction of the arrows of FIG. 4. The mandrel 18 is shown in cross-section. The side wheels 202, 300 contact the surfaces 302, 304 of the mandrel which are normal to the contact surfaces 206, 208, respectively, for the drive/positioning wheels 134, 136. In this way, the side wheels 202, 300 center the mandrel 18 inner and outer diameter surfaces 140, 142 within the contact surfaces 206, 208 of the drive/positioning wheels 134, 136, respectively.

Alternatively, the drive/positioning wheels 134, 136 can be flanged (not shown) with the flange being movable and attached to the drive/positioning wheel 134, 136 in such a way that it can be adjusted to apply pressure to the surfaces 302 and 304 of the mandrel 18. The adjustability can accommodate the varying thickness in the braid as braid layers are added to the mandrel 18.

Figure 8:
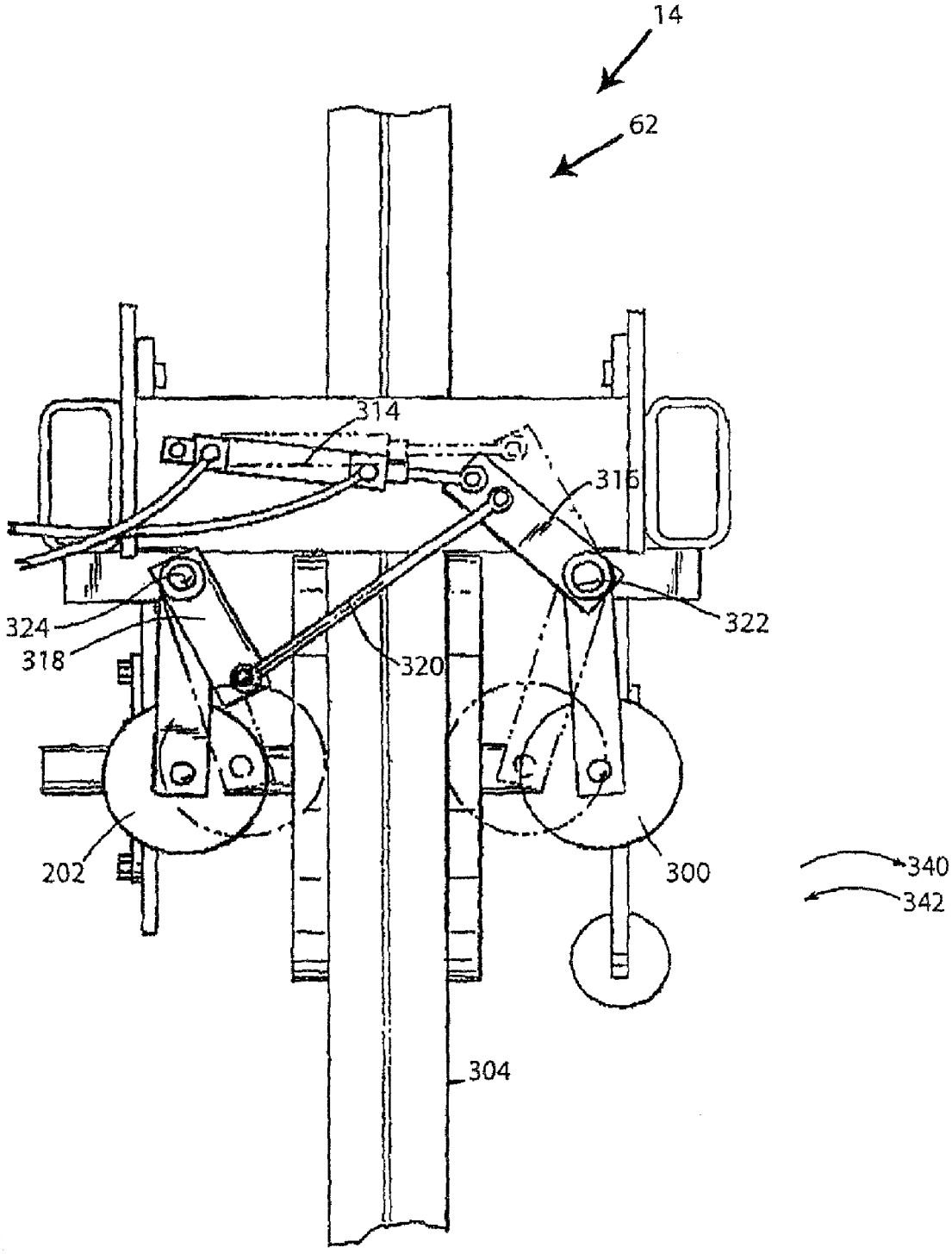
FIG. 8 is a diagrammatic side view of a set of side wheels including an illustration of the repositioning of components as a result of the actuation of the side wheels.

FIG. 8 provides a diagrammatic side view of the side wheels 202, 300 including an illustration of the repositioning of components as a result of the actuation of the side wheels 202, 300. As shown in the exploded view of FIG. 5B, the side wheel 202, 300 components include: two side wheels 202, 300, a side wheel bracket 310, 312 for each of the side wheels 202, 300, an air cylinder 314, two rotation plates 316, 318, a rotation plate connecting rod 320, two side wheel connecting rods 322, 324 and six support blocks 326-331. The air cylinder 314 connects to one end of the rotation plate 316 and the other end of the rotation plate 316 is connected to the side wheel connecting rod 322. The side wheel connecting rod 322 passes through a support block 329 and is inserted into second and third support blocks 330, 331. The support blocks 326-331 may be welded, or alternatively otherwise fastened to the carriage 200.

The side wheel connecting rod 322 is rotatable within the support blocks 329-331. The side wheel 300 is fixedly attached to a bracket 312, which is disposed in between the second 330 and third 331 blocks. The bracket 312 is fixedly attached to the side wheel connecting rod 322, and therefore rotates in conjunction with the rotation of the side wheel connecting rod 322. More particularly, the fixed connection between the bracket 312 and the side wheel connecting rod 322 results in the following operation of the side wheels 202, 300: when the rotation plate 316 is urged by the air cylinder 314, it rotates clockwise as shown by arrow 340; thereby rotating the rod 322 and causing the side wheel 300 to impinge against the surface 304 (see FIG. 7) of the mandrel 18. The rotation plate 316 is also connected to the another rotation plate 318 by the rotation plate connecting rod 320. The end of the rotation plate 318 opposite to the rotation plate connecting rod 320 attachment end is fixedly attached to a side wheel connecting rod 324. The side wheel connecting rod 324, similarly to the rod 322 for the side wheel 300, passes through a support block 326 and is inserted into second 327 and third 328 support blocks, which capture the bracket 310 of the side wheel 202.

In the example drive/positioning wheel assemblies 60, 62 disclosed herein, air cylinder 314 provides a binary operation, so that in an extended position, it urges the rotation plate 316 clockwise, which, in turn, rotates the side wheel connecting rod 322 clockwise in the direction of arrow 340 to drive the side wheel 300 to contact the mandrel 18 surface 304. Similarly, retraction of the air cylinder 314 urges the rotation plate 316 to rotate counterclockwise in the direction of the arrow 342 which, in turn, rotates the side wheel connecting rod 322 counterclockwise to withdraw the side wheel 300 from contact with the mandrel 18 surface 304.

When the rotation plate 316 rotates clockwise (based on an extension of the air cylinder, the rotation plate connecting rod 320 urges the rotation plate 318 to rotate counterclockwise in the direction of the arrow 342, which, in turn, rotates the side wheel connecting rod 324 counterclockwise to drive the side wheel 202 to contact the mandrel 18 surface 302. Similarly, when the rotation plate 316 rotates counterclockwise (based on a retraction of the air cylinder 314), the rotation plate connecting rod 320 urges the rotation plate 318 to rotate clockwise to withdraw the side wheel 202 from contact with the mandrel 18 surface 302. If multiple layers of braid 16 are formed on the mandrel 18, the side wheels 202, 300 can be repositioned to contact the altered mandrel surfaces 302, 304 by backing air out of the air cylinder 314.

The mandrel placement assembly 14 may optionally include support wheels 40, 42, 44, which assist in carrying the load of the mandrel 18, and in positioning the mandrel 18 together with the drive/positioning wheel assemblies 62, 60. As shown by way of example in FIG. 1, support wheels 40, 42, 44 are oriented around inner diameter surface 140 the mandrel 18. Alternatively, if the mandrel 18 is able support its own weight at the contact points of the drive/positioning wheel assemblies 62, 60, support wheels 40, 42, 44 may be eliminated.

In FIG. 1, support wheels 40, 42, 44 are suspended from the overhead crane beam 52. In alternative embodiments, additional support wheels 40, 42, 44 may be provided and supported in a base (as shown, for example, in FIGS. 17A and 17B). As various designs may be used according to the support requirements of the mandrel 18, the number, design and orientation of the support wheels as shown by way of example herein do not limit the scope of this invention.

Figure 9:
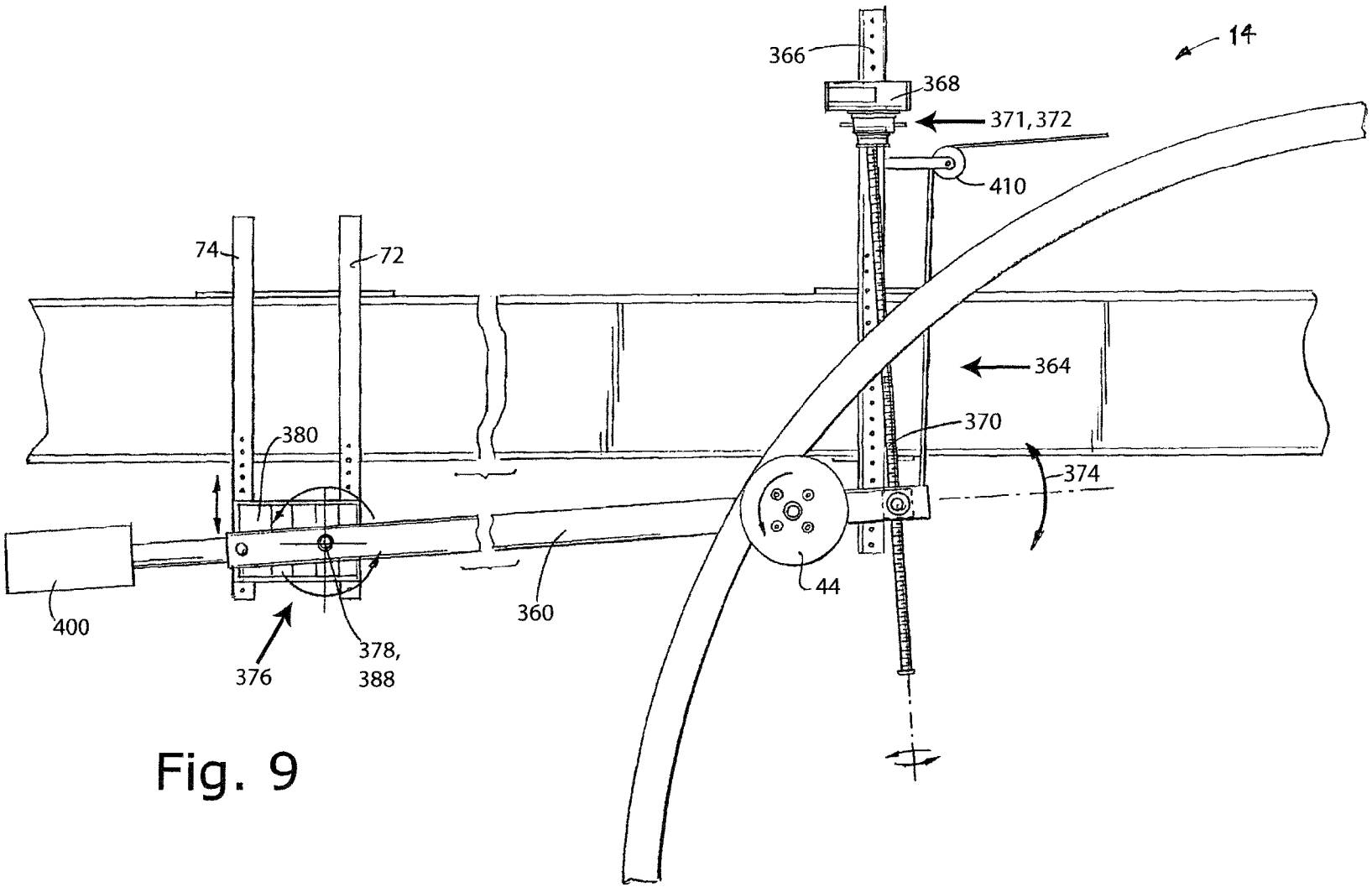
FIG. 9 is a fragmentary side view of one of the support wheels.

FIG. 9 is a fragmentary side view of one of the support wheels 44, which is also exemplary of the wheels 40, 42. The wheel 44 is rotatably connected to a support arm 360, and located proximally to one end of the arm 360. At the same end of the arm 360, a freely pivoting block 362 is housed (shown in FIG. 10B). The freely pivoting block 362 provides a point of attachment for the adjustable mounting system 364 as shown in FIG. 9. The adjustable mounting system 364 enables the support wheel 44 to move in space in order to adjust its position and carry the load of the mandrel 18 as the mandrel 18 is advanced by the drive/positioning wheel assemblies 62, 60.

The adjustable mounting system 364 includes: a vertical support 366 which fixedly attaches the system 364 to the crane beam 52, a lead screw 370 which is threaded through the freely pivoting block 362. Upon rotation of the lead screw 370, the support arm 360 is urged upwards or downwards along the length of the lead screw 370. The system 364 may also include a motor 368 coupled to a transmission for powering the rotation of the lead screw 370, whereby the lead screw 370 is driven by the transmission which may, for example, be designed as a worm gear drive 372. The lead screw 370 is connected to the worm gear drive 372 in a ball and socket joint (not shown), so that the lead screw 370 can float about its natural vertical orientation, thereby being capable of movement in three dimensions. For example, as shown in FIG. 9, the lead screw 370 is askew. The floating arrangement for the lead screw 370 is necessary to accommodate movement of the support wheel 44 along an arcuate path, as shown by arrow 374, the movement being caused by the connection proximal to the other end of the support arm 360 to a pivot support assembly 376.

A pivot assembly 376 enables movement of the support wheel 44 along the lead screw 370 through rotation about a pivot point 378. The assembly 376 includes two vertical supports 72, 74 which fixedly attach the assembly 376 to the crane beam 52, a positioning plate 380 having a bearing 382 which houses a ball and socket joint 384, and a shaft 386 that extends from the ball and socket joint 384 outwardly through a bearing 388 in the support arm 360 and is fixedly connected to the support arm 360. The ball and socket joint 384 enables the shaft 386 to float about its natural orientation, thereby enabling three dimensional movement of the support arm 360. As illustrated in FIG. 10B, the positioning plate 380 is also manually adjustable along the length of the vertical supports 72, 74. Alternatively, the adjustment may be automated.

Figure 10A:
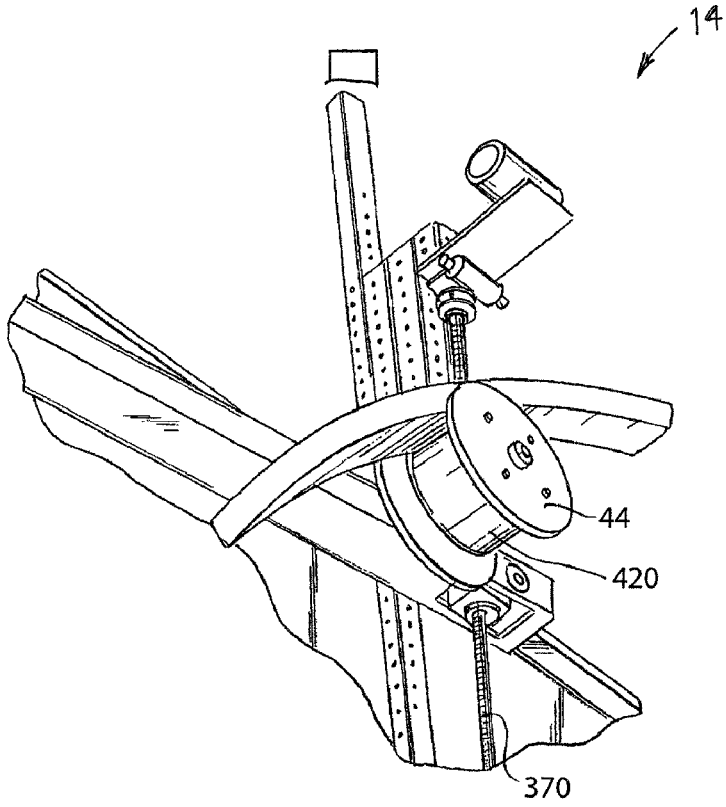
FIG. 10A is a fragmentary perspective view of the FIG. 9 support wheel.
Figure 10B:
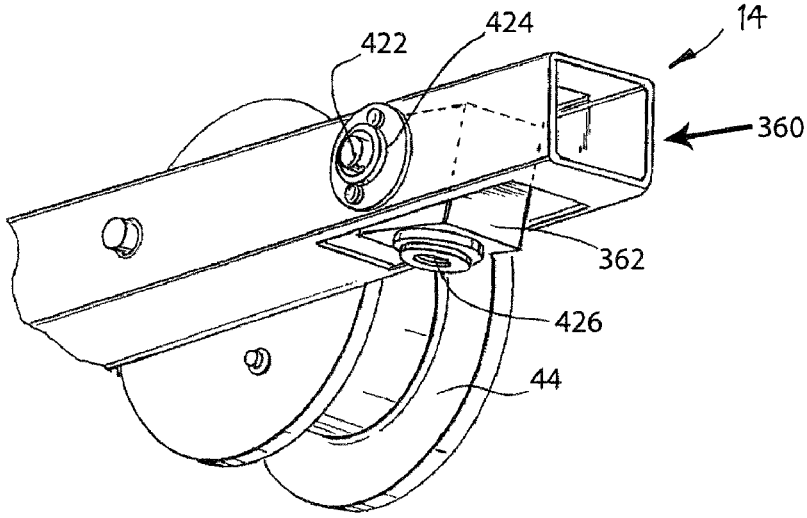
FIG. 10B is a fragmentary perspective view of the FIG. 10A support wheel and a freely pivoting block through which a lead screw is threaded.
Figure 10C:
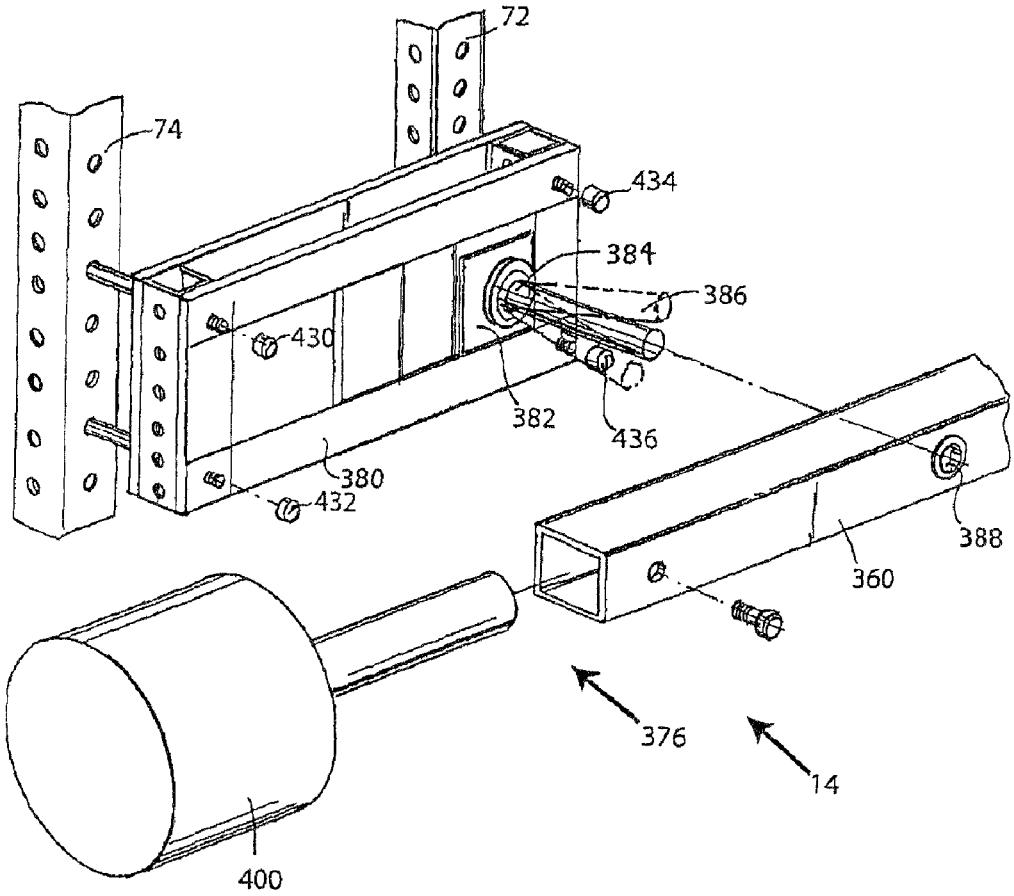
FIG. 10C is a fragmentary perspective view of a positioning plate of the FIG. 9 support wheel including an illustration of the ball and socket joint which connects the positioning plate to the end of the support arm closest to the counterweight.

As illustrated in FIG. 10C, the support wheel 44 is stabilized with the use of counterweights, for example, a selectively settable counterweight 400 for mandrel load control can extend from the support arm 360 on the end opposite to the support wheel 44. Such counterweight 400 can be oriented in a horizontal configuration, such as shown in this figure, or a vertical configuration, such as is shown in FIG. 1 counterweight 402. In addition, one or more load support arm counterweights 404, 406, 408 shown in FIG. 1 can be attached to the end of support arm 360 proximal to the support wheel 44 through a suspension pulley (the suspension pulley 410 is shown in FIG. 9).

In addition, the servo motor 368 also can provide a counterweight force to the support wheel 44 end of the support arm 360. In this case, separate weighted counterweights may be unnecessary. As the counterweight design will necessarily be dictated by the characteristics of the mandrel 18, the number, design and orientation of the counterweights do not limit the scope of this invention.

FIGS. 10A and 10B are fragmentary perspective views of the support wheel 44 and the freely pivoting block 362 through which the lead screw 370 is threaded. These figures also illustrate the recessed surface 420 of the support wheel 44 for positioning the mandrel 18. It is envisioned that the mandrel 18 will not contact the interior walls of the recess with less than a predetermined number of layers of braid. Should the number of layers increase beyond the predetermined number, then the flanges which create the recess in the support wheel 44 may be made to be adjustable.

As shown in FIG. 10B, the freely pivoting block 362 is connected to the support arm 360 by two rotatable shafts (one shaft 422 is shown), each of which passes through a bearing 424 mounted on the arm 360. The shafts 422 enable the pivoting block 362 to freely rotate. The block 362 also includes a flange 426 through which the lead screw 370 can be threaded, Rotation of the lead screw 370 causes the flange 426 to ride along the screw 370, thereby urging the support arm 360 to move along the length of the screw 360. Due to the arcuate path 374 (shown in FIG. 9) of the end of the support arm 360, the pivoting block 362 rotates to accommodate the movement of the lead screw 370 from its natural vertical orientation through movement along the x and y axes. Alternatively, the pivot block 362 can be designed to allow three dimensional movement.

FIG. 10C is a fragmentary perspective view of the positioning plate 380 including an illustration of the ball and socket joint 382 which connects the positioning plate 380 to the end of the support arm 360 closest to the counterweight 400. The positioning plate 380 is bolted via fastening means (for example, bolts 430, 432, 434, 436) to the vertical supports 72, 74. The ball and socket joint 384 houses a pivoting shaft 386 which is fixedly attached to the support arm 360. The ball and socket joint 384 supports two dimensional movement of the end of the support arm 360. However, in combination with the three dimensional movement of the lead screw 370 and the two dimensional movement supported by the freely pivoting block 362, the positioning plate 380 ball and screw joint 384 can provide for rotation of the end of the support arm 360 attached to the lead screw 370 along the z axis.

The braiding machine 10 is operated by means of a conventional computer numerical control (CNC) controller, coupled to components for determining the position of the mandrel 18 in its rotational travel. In view of the radiuses of curvature of the segments of the mandrel 18, the CNC controller is programmed to operate the previously-described actuating components of drive/positioning wheel assemblies 60, 62 (for example, VERSARAM 232, air cylinders 260, 314 and motor 280 of wheel assembly 62) to reposition and adjust the wheel assemblies 60, 62 and advance the mandrel 18.

Figure 11:
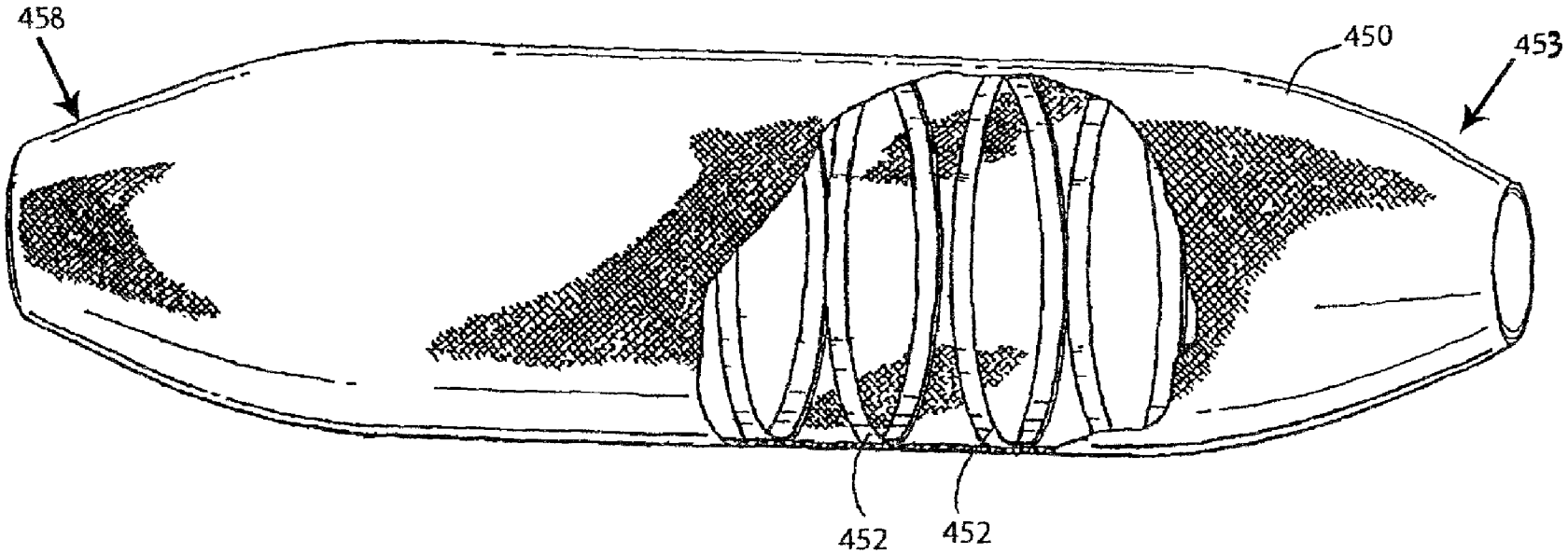
FIG. 11 is a conceptual fragmentary perspective view of an aircraft fuselage with a cutaway illustrating the arrangement of frames.
Figure 12:
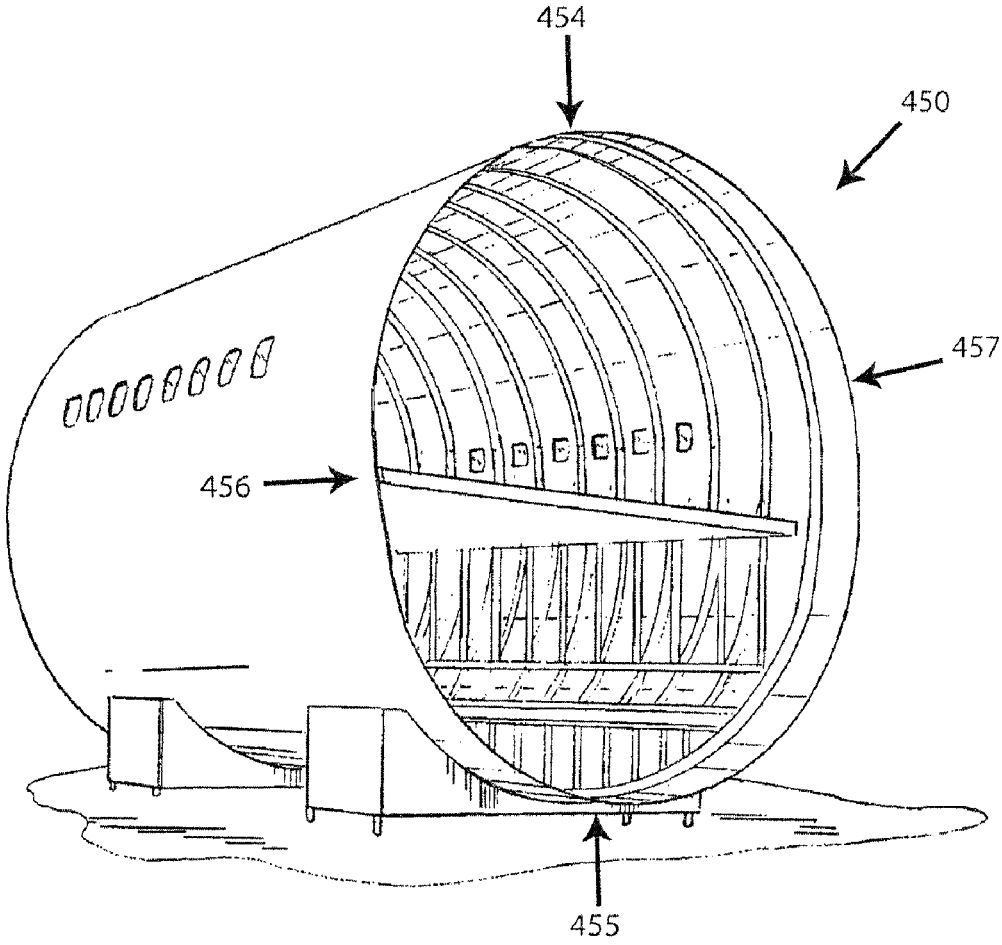
FIG. 12 is a fragmentary perspective view of the FIG. 11 aircraft fuselage with an illustration of the cross-section of the aircraft.

The construction of the mandrel 18 is now further described with reference to FIG. 11, a conceptual fragmentary perspective view of an aircraft fuselage 450 with a cutaway illustrating the arrangement of frames 452. The mandrel 18 provides a preform lay-up surface corresponding to frames 452 or sections of frames 452 of an aircraft fuselage 450. The frames 452 are arrayed like ribs down the length of the fuselage 450 from the forward section 454 to the aft section 453. FIG. 12 is a fragmentary perspective view of the aircraft fuselage 450 with an illustration of the cross-section of the aircraft. The cross-section of the fuselage 450 can be divided for descriptive purposes into four quadrants: the crown 454, belly or keel 455, and two sides 456, 457.

The frames 452 are arrayed like ribs down the length of the fuselage 450 from the forward section 458 to the aft section 453. FIG. 12 is a fragmentary perspective view of the aircraft fuselage 450 with an illustration of the cross-section of the aircraft. The cross-section of the fuselage 450 can be divided for descriptive purposes into four quadrants, the crown 454, belly or keel 455, and two sides 456, 457.

Figure 13:
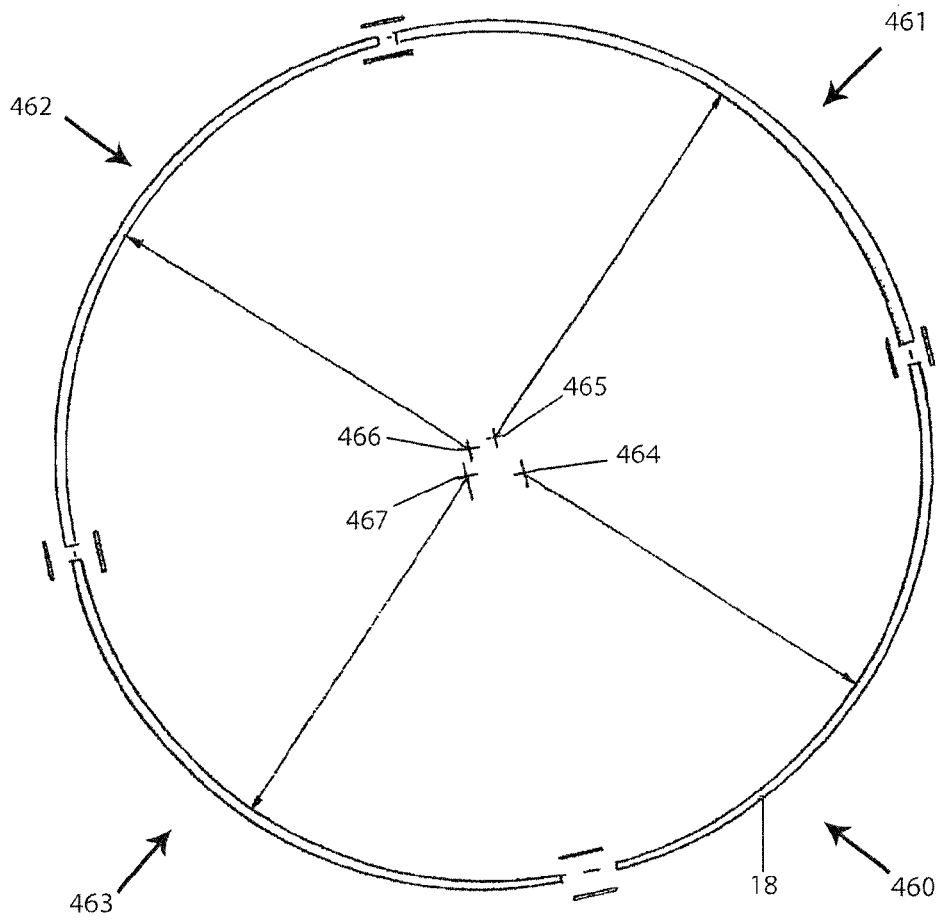
FIG. 13 is a side view of a mandrel with four sections, each of the mandrel sections has variations in the radius of curvature which results in varying centers of the mandrel for each of the sections.

FIG. 13 is a side view of a mandrel with four sections, 460-463 having variations in the radius of curvature which results in varying centers 464-467 for each of the sections 460-463, respectively. The frames 452 can vary in shape and size along the length of the fuselage 450. In addition, the frame size can vary from a small diameter (or approximate diameter based on the irregularly varying radius of curvature) for frames 452 near the fore and aft of the fuselage 450 to a larger diameter or approximate diameter for frames 452 midway along the length of the fuselage 450. In addition, an individual frame 452 may provide pieces to be used disparate areas of the fuselage 450, e.g., one or more from the fore section and one or more from the aft section.

Figure 14A:
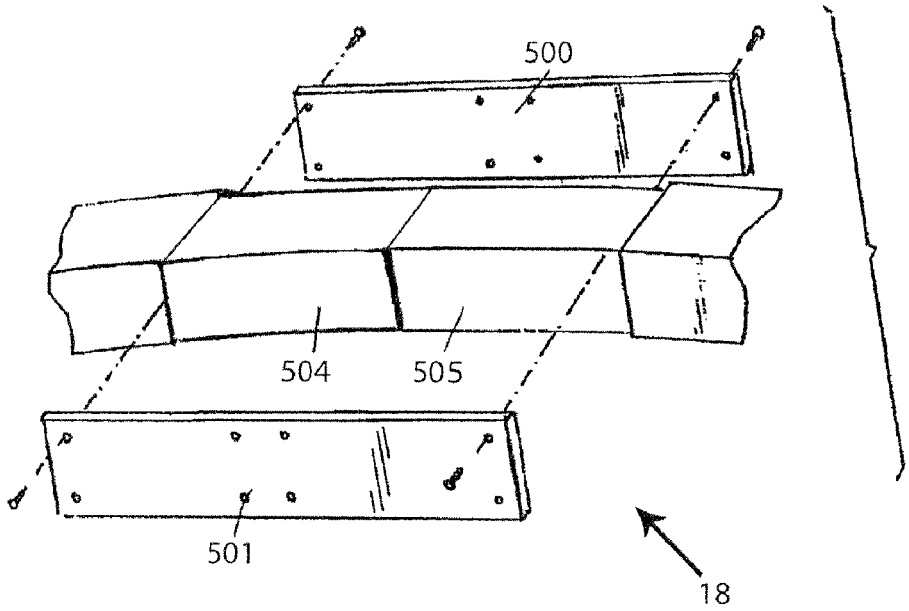
FIGS. 14A, 14B, and 14C are fragmentary exploded views of alternative splice plates for the connection of multiple sections of the mandrel.
Figure 14B:
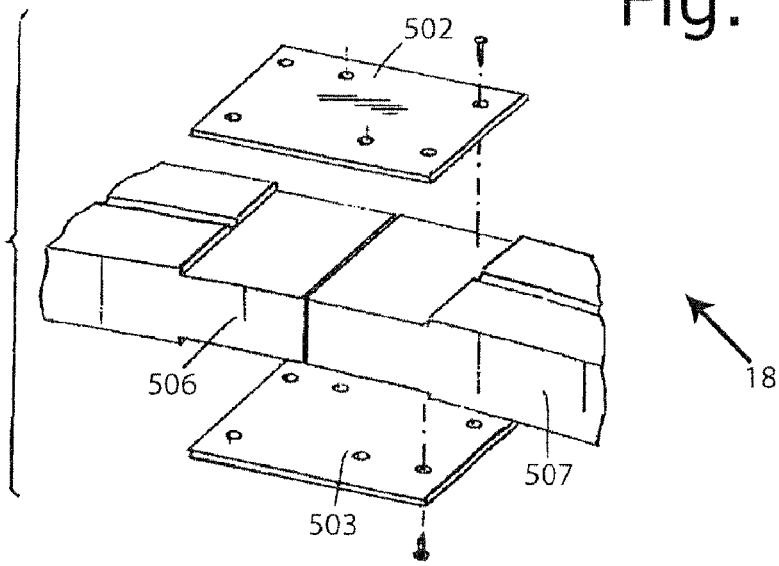
Figure 14C:
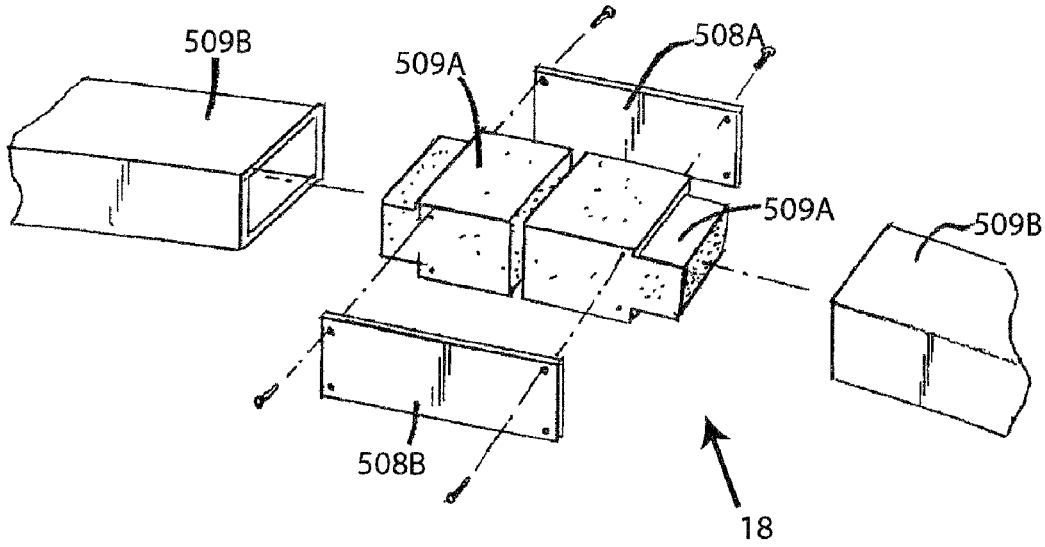

The composition and construction of the mandrel 18 to produce a finished braided product is now further described with reference to rigs 14A, 14B, and 14C. The mandrel 18 can be constructed from a variety of materials including, for example, wood, composite, and metal. When the mandrel 18 is constructed of multiple sections, as shown for example in FIG. 13, the sections can be combined to form a single structure for use in the braiding machine 10. One manner in which to combine the section is the use of splice or connection plates 500-503. FIGS. 14A, 14B, and 14C are fragmentary exploded views of alternative splice plates 500-503 for the connection of multiple sections 504-509 for the mandrel 18. The mandrel 18 sections 504-509 include recessed surfaces at their ends to accommodate the thickness of splice plates 500-503, 508A and 508B. The splice plates 500-503, 508A and 508B are then affixed to the mandrel sections 504-507, 509A and 509B. Also, mandrel portions 509A and 509B include components for an insertable fit of the splice plates 509A into the mandrel sections 509B. The splice plates 500-503 are inserted into the recessed surfaces and fastened with screws or the like to the sections to create a single structure from the two separate sections.

The composition and construction of the mandrel 18 to produce a finished braided product is now further described with reference to FIGS. 14A, 14B, and 14C. The mandrel 18 can be constructed from a variety of materials including, for example, wood, composite, and metal. When the mandrel 18 is constructed of multiple sections, as shown for example in FIG. 13, the sections can be combined to form a single structure for use in the braiding machine 10. One manner in which to combine the section is the use of splice or connection plates 500-503. FIGS. 14A and 14B are fragmentary exploded views of alternative splice plates 500-503 for the connection of multiple sections 504-507 for the mandrel 18. The mandrel 18 sections 504-507 include recessed surfaces at their ends to accommodate the thickness of splice plates 500-503, 508A and 508B. The splice plates 500-503 are then affixed to the mandrel sections 504-507. FIG. 14C is an exploded view of alternative spice plates 508A, 508B for the connection of multiple sections 509A, 509B for the mandrel 18. The mandrel 18 sections 509A, 509B include recessed surfaces at their ends to accommodate the thickness of splice plates 508A and 508B. The splice plates 508A and 508B are then affixed to the mandrel sections 509A and 509B. Also, mandrel portions 509A and 509B include components for an insertable fit of the splice plates 509A into the mandrel sections 509B. The splice plates 500-503 are inserted into the recessed surfaces and fastened with screws or the like to the sections to create a single structure from the two separate sections.

Figure 15A:
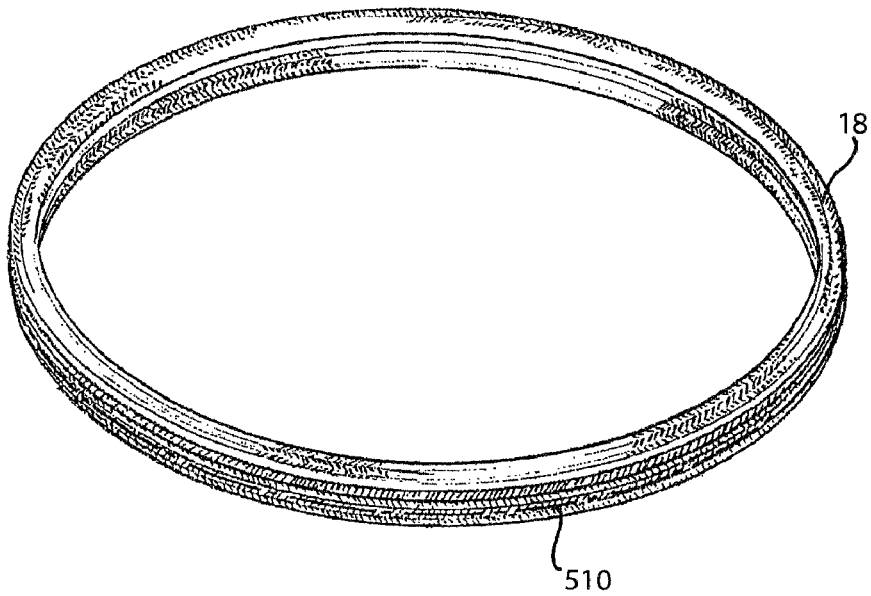
FIG. 15A is a perspective view of a mandrel as a single structure.
Figure 15B:
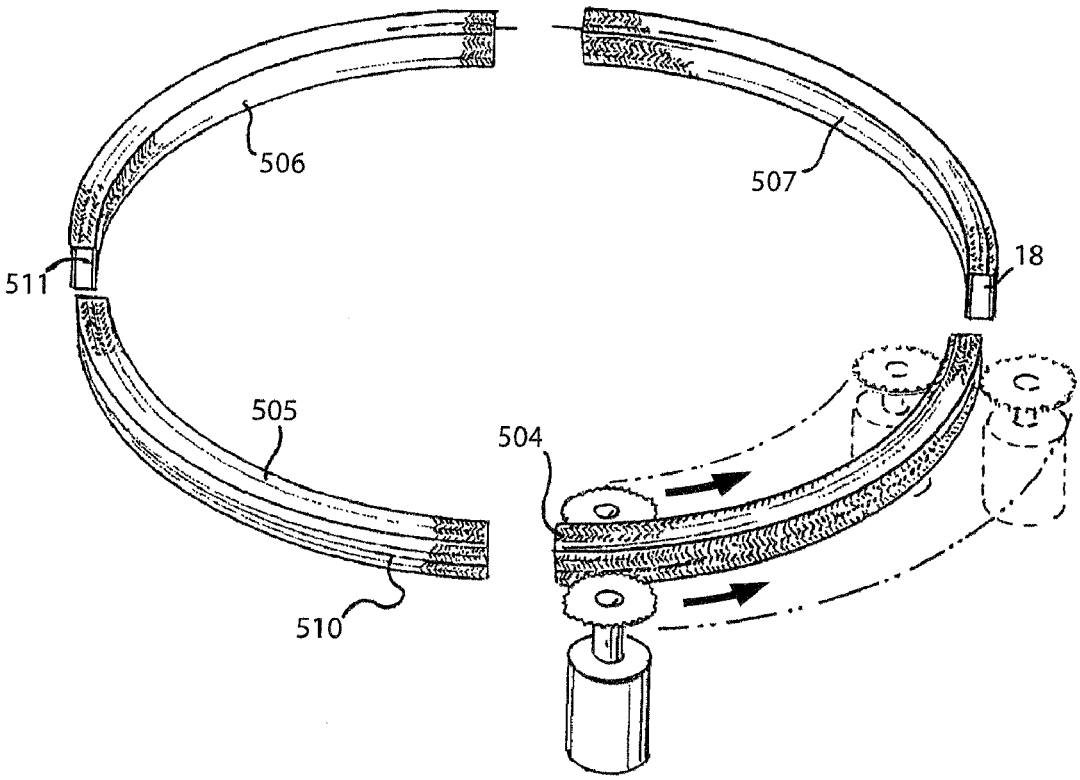
FIG. 15B is a perspective view of the FIG. 15A mandrel disassembled into four sections.
Figure 16:
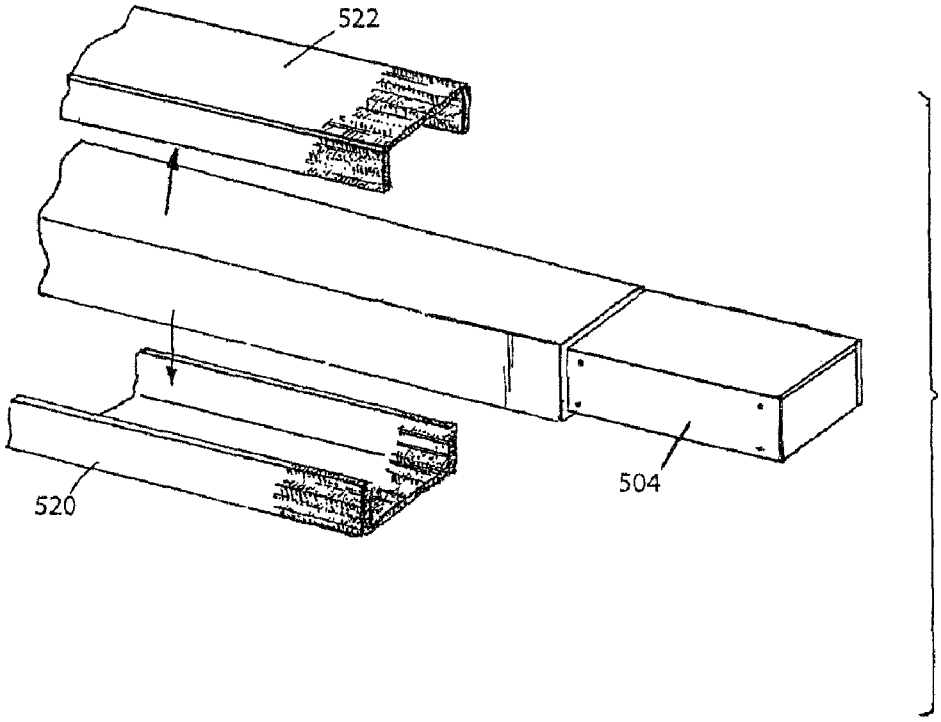
FIG. 16 is a fragmentary perspective view of the end of a section of the mandrel, including a recessed surface for accommodation of splice plates, and two sections of braid resulting from splicing the braid applied around the mandrel.

The mandrel 18 may also be constructed as a sandwich of two identical sections of fuselage frames 452 so that the braid 16 applied to the mandrel 18 is utilized for two frames 452. FIG. 15A is a perspective view of a mandrel 18 as a single structure and FIG. 15B is a perspective view of the mandrel disassembled into four sections. As shown in FIG. 15A, a mandrel 18 includes a center line 510 which bisects the mandrel 18 along its circumferential length. The center line 510 provides a conceptual indication of where the finished braided product can be slit, for example, to produce reinforcement for two sets of sections of frames 452. More particularly, the multiple layers of braid applied to the mandrel 18 can be slit on the center line 510 to create two U-shaped finished braid products (as shown in FIG. 16 as braids 520 and 522).

Alternatively, as shown in FIG. 15B, instead of slitting the length of the center line 510 initially, the sections 504-507 of the mandrel 18 may first be disassembled into four sections 504-507 by slitting the braided layers at the connection points between the sections 504-507, for example, at connection point 511. Each of the mandrel 18 sections 504-507 may then in addition be slit along the center lines 510 of each individual section 504, 505, 506 or 507 in the process described above with reference to FIGS. 15A, 15B.

Figure 17A:
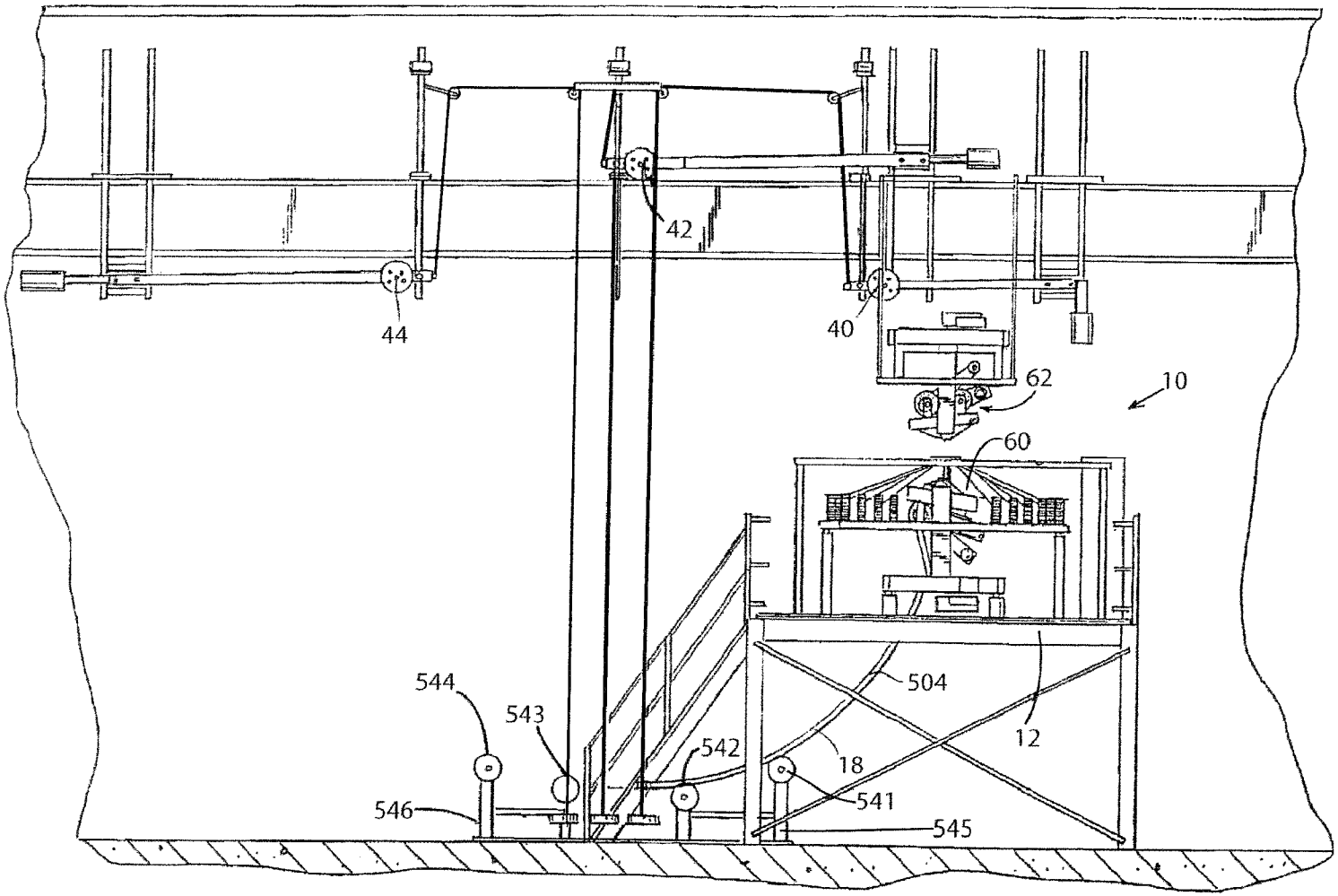
FIG. 17A is a side view of the FIG. 1 braiding machine with the first section of the mandrel being fed into the braiding apparatus.
Figure 17B:
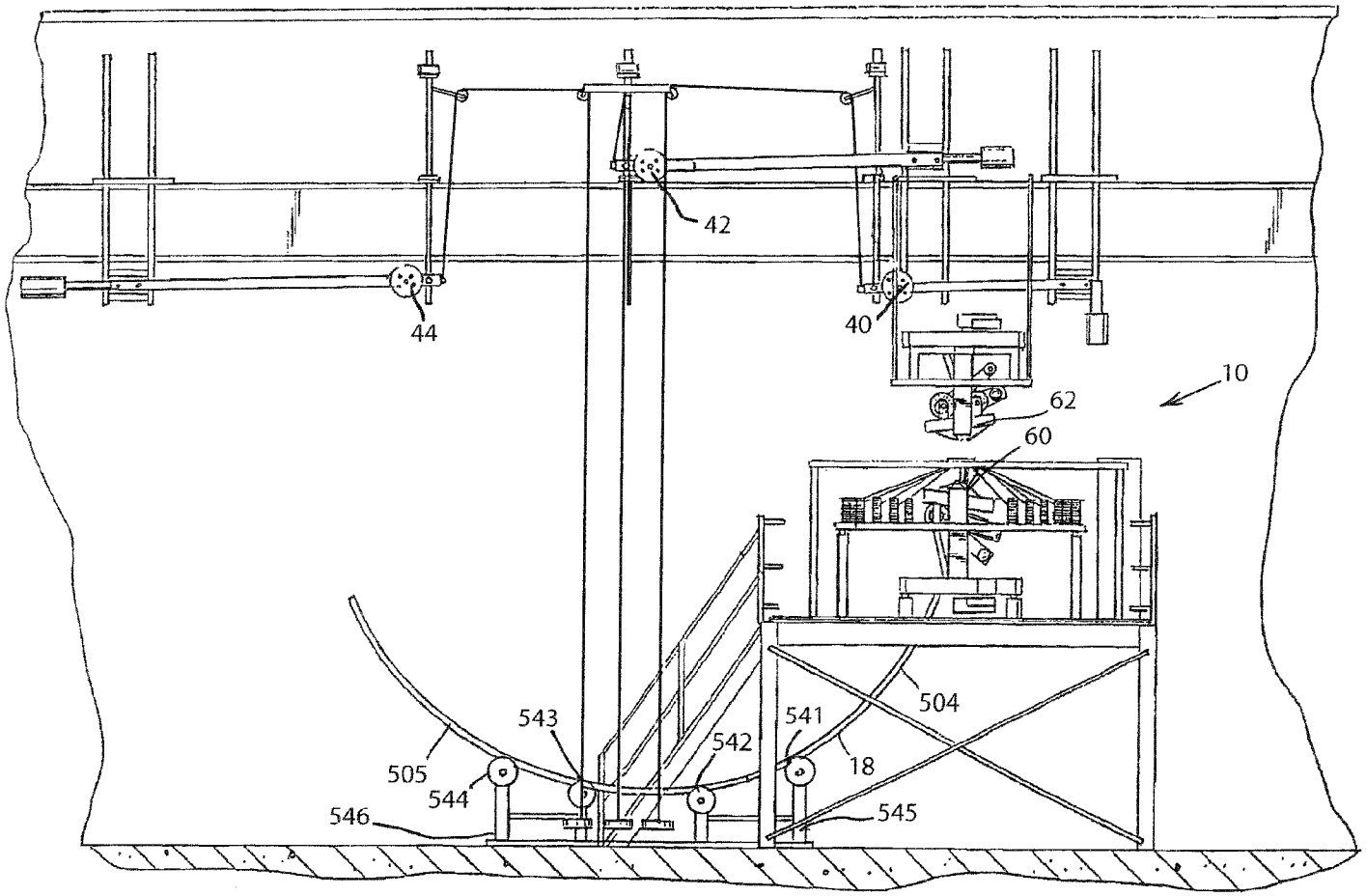
FIG. 17B is a side view of the FIG. 1 braiding machine with a second mandrel section being connected to the first mandrel section for translation through the braiding apparatus.

FIG. 17A is a side view of the braiding machine 10 of FIG. 1, showing a first section 504 of the mandrel 18 being fed into the braiding apparatus 12. In this case, braid 16 is applied to the first mandrel section 504 as it is fed into the braiding apparatus 12. Then, upon contact of the initial end of the first mandrel section 504 with the lower drive/positioning wheel assembly 60, as shown in FIG. 17B, a second mandrel section 505 is connected to the first mandrel section 504 for translation through the braiding apparatus 12. As the second mandrel 505 section is being fed into the lower drive/positioning wheel assembly 60, the first mandrel section 504 is being fed through the upper drive/positioning wheel assembly 62 and upwards to the first support wheel 40 (as shown in FIG. 1). During translation of the mandrel 18 sections into the braiding apparatus 12, the support wheels 40, 42, 44 can be adjusted to receive the mandrel 18 sections 504, 505 in the appropriate position as governed by the drive/positioning wheel assemblies 62, 60. The process continues in the same manner until each of the four mandrel sections 504-507 (or the number of mandrel sections used in the an alternative embodiment) are connected and the mandrel 18 is a completed approximately circular structure.

FIGS. 17A and 17B also illustrate an additional set of support wheels 541-544 used during the above-described procedure. Support wheels 541, 542 and 543, 544 support the weight of the mandrel 18 via bases 545, 546, respectively. Support wheels 541-544 also replace support wheels 40, 42, 44.

Those skilled in the art will readily recognize numerous adaptations and modifications which can be made to the present invention which fall within the spirit and scope of the present invention as defined in the claims, Moreover, it is intended that the scope of the present invention include all foreseeable equivalents to the elements and structures as described with reference to FIGS. 1-17B. Accordingly, the invention is to be limited only by the scope of the claims and their equivalents.

What is claimed is:

1. A method for applying a braided fabric over a mandrel using a braiding apparatus having a central axis and providing braiding yarns drawn toward a braiding point where a braid is formed on the mandrel, the method comprising the steps of:

advancing the mandrel through the braiding point of the braiding apparatus;

determining a current position of the mandrel; and controlling the position of a mandrel cross-section passing through the braiding point transversely to the central axis of the braiding apparatus responsive to the current position such that a center point of the mandrel cross-section passing through the braiding point is coincident with the braiding point.

2. The method of claim 1, wherein the advancing step is performed by at least one drive/positioning wheel assembly comprising at least one drive/positioning wheel adapted to frictionally engage at least one outer surface of the mandrel, the advancing step further comprising the step of:

rotating the at least one drive/positioning wheels in frictional contact with at least one of the opposing outer surfaces of the mandrel or layer of braid formed on the mandrel thereby advancing the mandrel.

3. The method of claim 1, wherein the advancing step is performed by at least one drive/positioning wheel assembly comprising a pair of drive/positioning wheels adapted to frictionally engage opposing outer surfaces of the mandrel, the advancing step further comprising the step of:

rotating the drive/positioning wheels in frictional contact with opposing outer surfaces of the mandrel or layer of braid formed on the mandrel thereby advancing the mandrel.

4. The method of claim 1, wherein the advancing step is performed by at least one drive/positioning wheel assembly comprising at least one drive/positioning wheel adapted to frictionally engage and advance the mandrel, wherein the at least one drive/positioning wheel assembly further comprises a carriage operatively carrying the at least one drive/positioning wheel, the carriage being pivotable about an axis transversely positioned with respect to the central axis of the braiding apparatus, wherein the step of controlling the position of the mandrel further comprises:

pivoting the carriage to adjust the position of the mandrel transversely to the central axis.

5. The method of claim 4, wherein the carriage pivotable about the axis transversely positioned with respect to the central axis is positioned in fixed relation to the braiding point.

6. The method of claim 1, wherein the step of determining a current position of the mandrel comprises determining the current position as a function of the radius of curvature along the length of the mandrel.

7. The method of claim 1, wherein the step of controlling the position of the mandrel is performed within a plane orthogonal to the central axis at the braiding point.

8. The method of claim 1, wherein the mandrel is characterized by a radius of curvature that varies along the length of the mandrel.

9. The method of claim 1, wherein the mandrel is characterized by a variable radius of curvature approximately circular in shape.

10. The method of claim 1, wherein the tubular braid formed around the outer-surface of the mandrel cross-section is symmetrically applied to the mandrel.

11. A braiding machine for applying a braided fabric to a mandrel, wherein the braiding machine includes a braiding apparatus having a central axis and providing braiding yarns drawn toward a braiding point where a braid is formed on the mandrel, the braiding machine comprising:

a mandrel placement assembly adapted to operatively position the mandrel transversely to the central axis of the braiding apparatus such that a center point of a mandrel cross-section passing through the braiding apparatus is coincident with the braiding point and to advance the mandrel through the braiding point of the braiding apparatus, the mandrel placement assembly comprising at least one drive/positioning wheel assembly comprising at least one drive/positioning wheel adapted to frictionally engage at least one outer surface of the mandrel, the at least one drive/positioning wheel being operative to rotate in frictional contact with at least one of the opposing outer surfaces of the mandrel or layer of braid formed on the mandrel thereby advancing the mandrel, and a carriage operatively carrying the at least one drive/positioning wheel, the carriage being pivotable about an axis transversely positioned with respect to the central axis of the braiding apparatus, the carriage being pivotable to position the at least one drive/positioning wheel to adjust the position of the mandrel transversely to the central axis.

12. The braiding machine of claim 11, wherein the mandrel placement assembly comprises a pair of drive/positioning wheel assemblies, each one of the pair of drive/positioning wheel assemblies being operatively positioned on an opposing side of the braiding point.

13. The braiding machine of claim 11, wherein the at least one drive/positioning wheel assembly comprises a pair of drive/positioning wheels adapted to frictionally engage opposing outer surfaces of the mandrel or layer of braid formed on the mandrel.

14. The braiding machine of claim 13, wherein the at least one drive/positioning wheel assembly further comprises opposing side wheels in a direction orthogonal to the opposing drive/positioning wheels, the opposing side wheels adapted to control the position of the mandrel in the direction orthogonal to the opposing drive/positioning wheels.

15. The braiding machine of claim 11, wherein the at least one drive/positioning wheel assembly further includes a drive/positioning wheel adjustment mechanism, the drive/positioning wheel adjustment mechanism comprising:

first and second axles for mounting the opposing drive/positioning wheels;

holder plates each carrying an end of one of the first and second axles at a first end and being pivotally mounted to the carriage at a second end, wherein first and second ones of the holder plates that hold one of proximal or distal ends of the first and second axles are teeth plates, wherein teeth on each of the first and second holder plates are enmeshed so that a pivotal movement of one of the opposing drive/positioning wheels held by the first holder plate causes a coordinated movement of the other one of the opposing drive/positioning wheels held by the second holder plate in an opposite pivotal direction.

16. The braiding machine of claim 15, wherein the at least one drive/positioning wheel assembly further comprises a linear actuator coupled to first ends of third and fourth holder plates holding ends of the first and second axles, respectively, the linear actuator being configured to drive the pivotal movements of the opposing drive/positioning wheels.

17. The braiding machine of claim 15, wherein the drive/positioning wheel adjustment mechanism further comprises:

a drive mechanism for driving a coordinated rotational movement of the opposing drive/positioning wheels such that when one of the opposing drive/positioning wheels moves in a first rotational direction, the other of the opposing drive/positioning wheels moves in an opposite rotational direction.

18. The braiding machine of claim 15, wherein the drive/positioning wheel adjustment mechanism further comprises:

a motor coupled to the drive mechanism.

19. The braiding machine of claim 15, wherein the at least one drive/positioning wheel assembly further comprises a side wheel adjustment mechanism, the side wheel adjustment mechanism comprising:

side brackets pivotally coupling each opposing side wheel to the carriage; and a linkage mechanism coupled to each side bracket and being configured so that a pivotal movement of one of the opposing side wheels causes a coordinated movement of the other one of the opposing side wheels held in an opposite pivotal direction.

20. The braiding machine of claim 19, wherein the side wheel adjustment mechanism further comprises a linear actuator coupled to the linkage mechanism and adapted to drive the pivotal movements of the opposing side wheels.

21. The braiding machine of claim 11, wherein the at least one drive/positioning wheel assembly carriage further comprises:

a support beam for pivotally mounting the carriage at the pivotable axis; and a linear actuator mounted between the carriage and the support beam for causing movements of the carriage.

22. The braiding machine of claim 21, further comprising:

a computer numerical control (CNC) controller adapted to determine a current position of the mandrel, and operate the linear actuator to control the position of the mandrel transversely to the central axis of the braiding apparatus responsive to the current position such that a center point of a mandrel cross-section passing through the braiding apparatus is coincident with the braiding point.

23. The braiding machine of claim 22, wherein the controller determines the current position as a function of the radius of curvature along the length of the mandrel.

24. The braiding machine of claim 22, wherein the step of controlling the position of the mandrel is performed within a plane orthogonal to the central axis at the braiding point.

25. The braiding machine of claim 11, wherein the carriage pivotable about the axis transversely positioned with respect to the central axis is positioned in fixed relation to the braiding point.

* * * * *